US012733691B2

(12) United States Patent
White et al.

(10) Patent No.: US 12,733,691 B2
(45) **Date of Patent: *Sep. 15, 2026**

(54) ODOR CONTROL GARMENT WITH INSERT

(71) Applicant: Stitches Medical, Inc., Napa, CA (US)

(72) Inventors: Collin White, Saint Helena, CA (US); Robert White, Scottsdale, CA (US)

(73) Assignee: Stitches Medical, Inc., Napa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/982,432

(22) Filed: Dec. 16, 2024

(65) Prior Publication Data

US 2025/0143384 A1 May 8, 2025

Related U.S. Application Data

(63) Continuation-in-part of application No. 18/387,781, filed on Nov. 7, 2023, now Pat. No. 12,213,538, which is a continuation of application No. 18/123,059, filed on Mar. 17, 2023, now Pat. No. 11,844,379, which is a continuation of application No. 17/825,259, filed on May 26, 2022, now Pat. No. 11,612,191, which is a continuation of application No. 17/675,684, filed on Feb. 18, 2022, now Pat. No. 11,375,756.

(51) Int. Cl.

| | |
|---|---|
| ***A41B 9/02*** | (2006.01) |
| ***A41B 9/00*** | (2006.01) |
| ***A41B 9/14*** | (2006.01) |

(52) U.S. Cl.

CPC ..... *A41B 9/02* (2013.01); *A41B 9/001* (2013.01); *A41B 9/004* (2013.01); *A41B 9/14* (2013.01); *A41B 2400/36* (2013.01)

(58) Field of Classification Search

CPC ..... A41B 9/02; A41B 9/001; A41B 9/004; A41B 9/14; A41B 2400/36

See application file for complete search history.

(56) References Cited

U.S. PATENT DOCUMENTS

| | | | | |
|---|---|---|---|---|
| 1,784,744 A | | 12/1930 | Negley | |
| 2,116,822 A | * | 5/1938 | Berger | A41B 9/02 2/404 |
| 2,384,165 A | | 9/1945 | Goldfarb et al. | |
| 2,435,945 A | | 2/1948 | Redmond | |
| 3,246,341 A | * | 4/1966 | Paolucci | A41B 9/02 2/404 |

(Continued)

*Primary Examiner* — Khaled Annis

(74) *Attorney, Agent, or Firm* — Kenneth Altshuler

(57) ABSTRACT

The embarrassment of passing gas in public is ubiquitous. Accordingly, certain aspects of the present invention are directed to providing filter underwear (also known as underpants) that is generally constructed with a single ply of underwear side panels that are separated by an activated carbon center panel that is removable from the underwear. Certain embodiments contemplate an odor control underwear being an underwear system that generally includes an underwear comprising a pocket that is fit to accommodate a removable activated carbon adsorbent sleeve. Accordingly, after at least one use (i.e., a time of wearing the underwear system), the adsorbent sleeve can be removed from the accommodating pocket, and therefore the underwear, whereby the adsorbent sleeve can be washed, dried, and reinserted in the accommodating pocket for another underwear use.

16 Claims, 20 Drawing Sheets

(56) References Cited

U.S. PATENT DOCUMENTS

| | | | | |
|---|---|---|---|---|
| 3,706,103 | A | 12/1972 | Senser | |
| 4,143,197 | A | 3/1979 | Jasionowicz | |
| 5,546,607 | A | 8/1996 | Roberts | |
| 5,593,398 | A | 1/1997 | Weimer | |
| 5,665,081 | A | 9/1997 | Grosse | |
| 7,745,684 | B2 | 6/2010 | Huza et al. | |
| 7,934,268 | B2 | 5/2011 | Newman | |
| 8,051,495 | B2 | 11/2011 | Lee | |
| 8,935,813 | B2 | 1/2015 | O'Leary | |
| 9,924,746 | B1 * | 3/2018 | Davis | A41B 9/023 |
| 11,154,431 | B1 | 10/2021 | Yip et al. | |
| 11,375,756 | B1 * | 7/2022 | White | A41B 17/00 |
| 2003/0187412 | A1 | 10/2003 | Martin | |
| 2004/0010841 | A1 | 1/2004 | Gilmartin | |
| 2005/0182372 | A1 | 8/2005 | Huza | |
| 2007/0032771 | A1 * | 2/2007 | Abed | A61F 13/49006 604/385.22 |
| 2009/0139003 | A1 * | 6/2009 | Lee | A41B 9/12 2/400 |
| 2016/0286971 | A1 | 10/2016 | Pan | |
| 2019/0320726 | A1 * | 10/2019 | Profeta | A41B 17/00 |
| 2020/0054495 | A1 * | 2/2020 | Pelt | A61F 13/5616 |
| 2020/0079051 | A1 | 3/2020 | Nicholson | |
| 2020/0170309 | A1 * | 6/2020 | Ewell | A41D 31/145 |
| 2021/0177068 | A1 * | 6/2021 | Karabetyan | A41B 9/023 |
| 2021/0206144 | A1 * | 7/2021 | Ewell | A41D 13/11 |
| 2021/0259326 | A1 * | 8/2021 | Shaughnessy | A41B 9/023 |
| 2021/0298369 | A1 * | 9/2021 | Polstein | A41B 9/00 |
| 2022/0079250 | A1 * | 3/2022 | Calamia | A41B 9/001 |
| 2022/0127784 | A1 * | 4/2022 | Handlin, Jr. | D06P 3/3206 |

* cited by examiner

ODOR CONTROL GARMENT WITH INSERT

The clean version of the amended specification replaces all prior versions of the specification. The amendments are proper and add no new subject matter.

CROSS-REFERENCE TO RELATED APPLICATIONS

This continuation-in-part patent application claims priority to and the benefit of U.S. patent application Ser. No. 18/387,781 entitled Odor Control Garment, filed on Nov. 7, 2023, which claims priority to and the benefit of U.S. Pat. No. 11,844,379 (application Ser. No. 18/123,059) entitled Filtered Garment, filed on Mar. 17, 2023, which claims priority to and the benefit of U.S. Pat. No. 11,612,191 (application Ser. No. 17/825,259) entitled Filter Underwear, filed on May 26, 2022, which claims priority to and the benefit of U.S. Pat. No. 11,375,756 (application Ser. No. 17/675,684) entitled Filter Underwear, filed on Feb. 18, 2022.

FIELD OF THE INVENTION

The present embodiments are directed to undergarments.

BACKGROUND OF THE INVENTION

The embarrassment of passing gas in public is typically offensive to those who are subject to its odor. Some have attempted to hide the offensive odor of flatulence with perfumes and filters. Attempts have been made to incorporate perfumes and filters in garments with varied levels of success. In certain instances, difficult to manufacture panel shapes have been incorporated in clothing, such as underwear described in U.S. Pat. No. 8,935,813 to O'Leary. O'Leary teaches a non-filter material bounded between a portion of filter material and edging at the underwear leg opening in bikini style briefs requiring complex seams that need to be sewn, which is undesirable in a manufacturing environment. Furthermore, O'Leary teaches a filter material that extends from a waist band on the rear side of his garment, down to the gusset region and through the gusset such that the filter material section terminates at a seam on the front panel. This design is poor because it does nothing to prevent passed gas from flowing through the non-filter material in the front between the front seam and the waist band. Others have attempted to make entire undergarments out of filter material, but this is cumbersome, uncomfortable to the wearer and simply an unsuccessful approach in controlling the escape of flatulence. Still others espouse the advantages of underwear that is under 1 mm thick, which is sorely deficient in properly reducing flatulence odor and therefore considered inferior for such purposes. It is to innovations related to this subject matter that the embodiments of the invention are generally directed.

SUMMARY OF THE INVENTION

The present embodiments are directed to odor controlling underwear.

With this in mind, certain embodiments of the present invention therefore contemplate underwear with a removable odor mitigating sleeve. The underwear can comprise a center panel separating a first and a second side panel, wherein the center panel traverses a crotch region. The center panel extends towards a waistband at a waistband front and a waistband rear. The first side panel extends from the waistband to a first leg aperture and the second side panel extends from the waistband to a second leg aperture. The crotch region separates each of the leg apertures. The side panels comprise a single layer of fabric and the center panel comprises two layers of the fabric, wherein the center panel comprising a pocket between the two layers. The center panel further comprises a front access port at the waistband front and a rear access port at the waistband rear. The underwear further comprises an adsorbent sleeve that is configured to be disposed in the pocket. The adsorbent sleeve is configured to be constrained at the front access port and the rear access port. The adsorbent sleeve unconstrained within the pocket. The adsorbent sleeve comprises an activated carbon sheet joined between a bamboo fabric.

Yet another embodiment of the present invention further contemplates a filter underwear with a removable odor mitigating sleeve. The underwear can comprise a center panel that separates a pair of side panels. The center panel traversing a crotch region. The center panel can also comprise a front access port at a waistband front and a rear access port at a waistband rear. The crotch region separates a pair of leg apertures. The side panels can comprise a single layer of fabric, wherein the center panel can comprise two layers of the fabric. The center panel comprises a pocket defined between the two layers. The filter underwear can further comprise an adsorbent sleeve removably disposed in the pocket and constrained at the front access port and the rear access port. Except for at the front access port and the rear access port, the adsorbent sleeve is unconstrained within the pocket. The adsorbent sleeve comprises an activated carbon sheet joined between a bamboo fabric.

Still another embodiment of the present invention contemplates a method to combine an adsorbent sleeve in a filter underwear. The method comprising a step for inserting the adsorbent sleeve in either a front access port or a rear access port of a panel pocket of a center panel having two fabric layers, wherein the front access port and the rear access port are located approximately at a waistband of the filter underwear. The adsorbent sleeve comprises an activated carbon sheet that is joined between a first and a second layer of bamboo fabric. The method further comprising a step for sealing the rear access port by connecting a first end of the adsorbent sleeve at a rear lip of the panel pocket and sealing the front access port by connecting a second end of the adsorbent sleeve at a front lip of the panel pocket. The adsorbent sleeve unconstrained in the panel pocket except for at the first end and the second end.

DETAILED DESCRIPTION

Figure 1A:
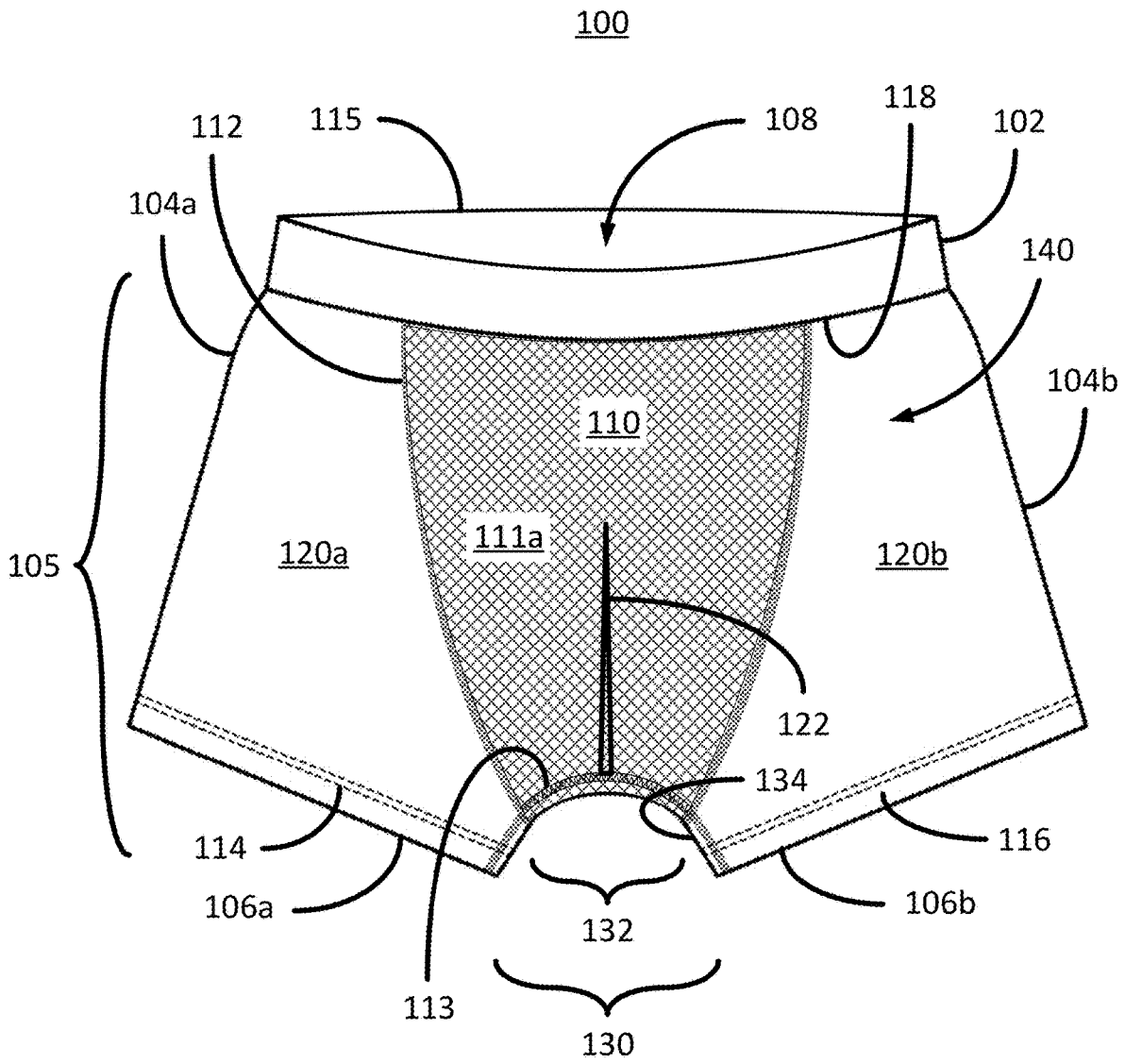
FIGS. 1A and 1B are line drawings of front and back views of underwear embodiments consistent with embodiments of the present invention.

Initially, this disclosure is by way of example only, not by limitation. Thus, although the instrumentalities described herein are for the convenience of explanation, shown and described with respect to exemplary embodiments, it will be appreciated that the principles herein may be applied equally in other similar configurations involving similar uses of filter material with undergarments. The phrases "in one embodiment", "according to one embodiment", and the like, generally mean the particular feature, structure, or characteristic following the phrase, is included in at least one embodiment of the present invention and may be included in more than one embodiment of the present invention. Importantly, such phases do not necessarily refer to the same embodiment. If the specification states a component or feature "may", "can", "could", or "might" be included or have a characteristic, that particular component or feature is not required to be included or have the characteristic. As used herein, the terms "having", "have", "including" and "include" are considered open language and are synonymous with the term "comprising". Furthermore, as used herein, the term "essentially" is meant to stress that a characteristic of something is to be interpreted within acceptable tolerance margins known to those skilled in the art in keeping with typical normal world tolerance, which is analogous with "more or less." For example, essentially flat, essentially straight, essentially on time, etc. all indicate that these characteristics are not capable of being perfect within the sense of their limits. Accordingly, if there is no specific +/−value assigned to "essentially", then assume essentially means to be within +/−2.5% of exact. In what follows, similar or identical structures may be identified using identical callouts.

The embarrassment of passing gas in public is ubiquitous. Accordingly, certain aspects of the present invention are directed to providing filter underwear (also known as underpants) that is generally constructed with a single ply of underwear side panels that are separated by an activated carbon center panel that is removable from the underwear. Certain embodiments contemplate an odor control underwear being an underwear system that generally includes an underwear comprising a pocket that is fit to accommodate a removable activated carbon adsorbent sleeve. Accordingly, after at least one use (i.e., a time of wearing the underwear system), the adsorbent sleeve can be removed from the accommodating pocket, and therefore the underwear, whereby the adsorbent sleeve can be washed, dried, and reinserted in the accommodating pocket for another underwear use.

Another embodiment of the present invention contemplates the activated carbon center panel being attached to an elastic waistband at the underwear back and where the activated carbon center panel traverses between two leg openings to the waistband at the underwear front. The center panel is configured to only extend over part of a wearer's buttocks when worn by a wearer. The center panel is constructed with a five-ply activated carbon fabric that is sandwiched between cotton fabric, which is sandwiched between bamboo fabric. The five-ply center panel is greater than 1 mm thick to provide filtering capabilities to sufficiently reduce the odor of flatulence to an acceptable level that is not readily detected by a person close by to the wearer of the activated carbon underwear. The embodiments described below in view of the figures illustrate examples of filter underwear to assist in understanding aspects of the present invention.

Figure 1B:
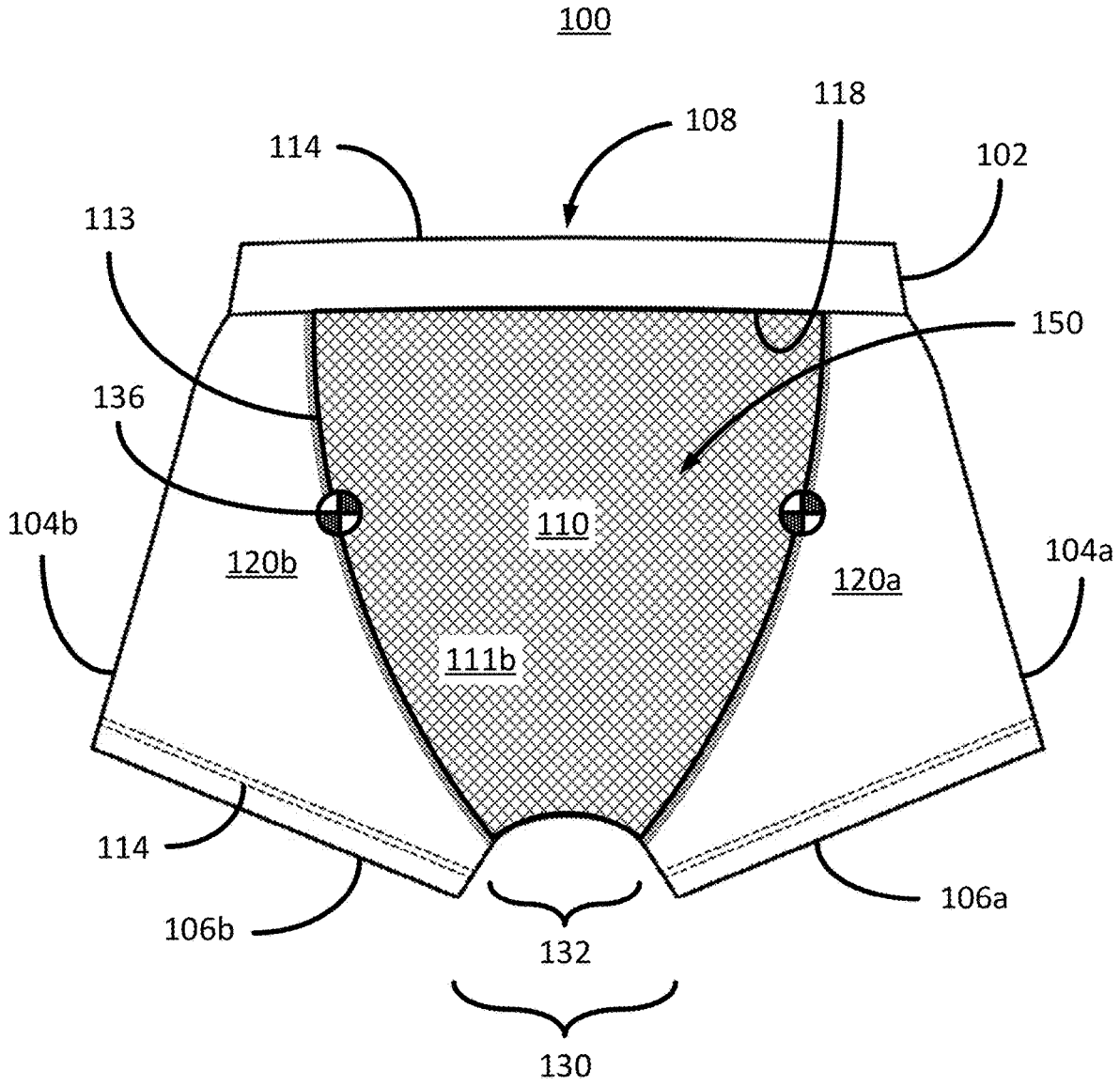

FIGS. 1A and 1B are line drawings of front and back views of underwear embodiments consistent with embodiments of the present invention. As shown in FIG. 1A, the underwear embodiment 100 generally comprises an underwear body 105 that extends between a waist opening 108 and two leg openings 106*a* and 106*b*. The terminology "opening/s" as used herein is synonymous with "apertures" and can be positively recited as "apertures". Also, the leg openings 106*a* and 106*b* can be generically called-out as element 106, meaning a leg opening 106 could be either leg opening 106*a* or 106*b* and leg openings 106 can refer to both leg openings 106*a* and 106*b*. In this embodiment, the underwear body 105 includes the side panels 120*a* and 120*b*, the center panel 110 and all connective stitching, such as the front side panel interface 112 (i.e., seams) that fixedly connect the panels 120 and 110 together. The side panels 120*a* and 120*b* can be generically called-out as element 120, meaning a side panel 120 could be either side panel 120*a* or 120*b* and side panels 120 can refer to both side panels 120*a* and 120*b*. At its open edge 115, an inseparable unitary elastic waistband 102 defines the waist opening 108. The inseparable unitary elastic waistband 102 is sewn to the side panels 120 and the center panel 110 at waistband seam 118. The elastic waistband 102 is inseparable and unitary in that it is a single band that is sewn together. As such, one part of the elastic waistband 102 cannot be separated from another part of the elastic waistband 102 without destroying the elastic waistband 102, hence inseparable and unitary. A separable waistband is considered a waistband that creates a waistband hoop by closing at least two ends with a nonpermanent closing connector (hereinafter "NCC"), such as VELCRO® Brand hook and loop fasteners, latches, snaps, tape, etc. These nonpermanent closing connectors permit separating a separable waistband as well.

The underwear garment 100 is geometrically defined by two underwear sides 104*a* and 104*b*, an underwear front 140 (FIG. 1A), an underwear back 150 (FIG. 1B), the underwear waist opening 108, and a crotch region 130 that separates the leg openings 106. The two underwear sides 104*a* and 104*b* can be generically called-out as element 104, meaning an underwear side 104 could either be underwear side 104*a* or 104*b* and underwear sides 104 can refer to both underwear sides 104*a* and 104*b*. As shown, the underwear' crotch region 130 (or simply crotch region) is defined as the material between each of the leg openings 106, wherein each leg opening 106 extends from a corresponding underwear side 104 to the crotch region 130. In the present embodiment, there is no gusset in the crotch region 130 thereby reducing the number of manufacturing steps. The elimination of a gusset is believed far superior in the overall construction, with minimal to no sacrifice in comfort. Nonetheless, certain embodiments could utilize a gusset in the crotch region without departing from core aspects of the present invention. In the present embodiment, a center panel crotch portion 132 is smaller than, but incorporated in, the 'overall' crotch region 130 that separates the leg openings 106. The leg openings 106 include a leg cuff 116 of folded over material from the corresponding side panel 120 that is sewn in place by leg seam 114. Some embodiments envision the leg cuff 116 incorporating an elastic band.

Figure 3:
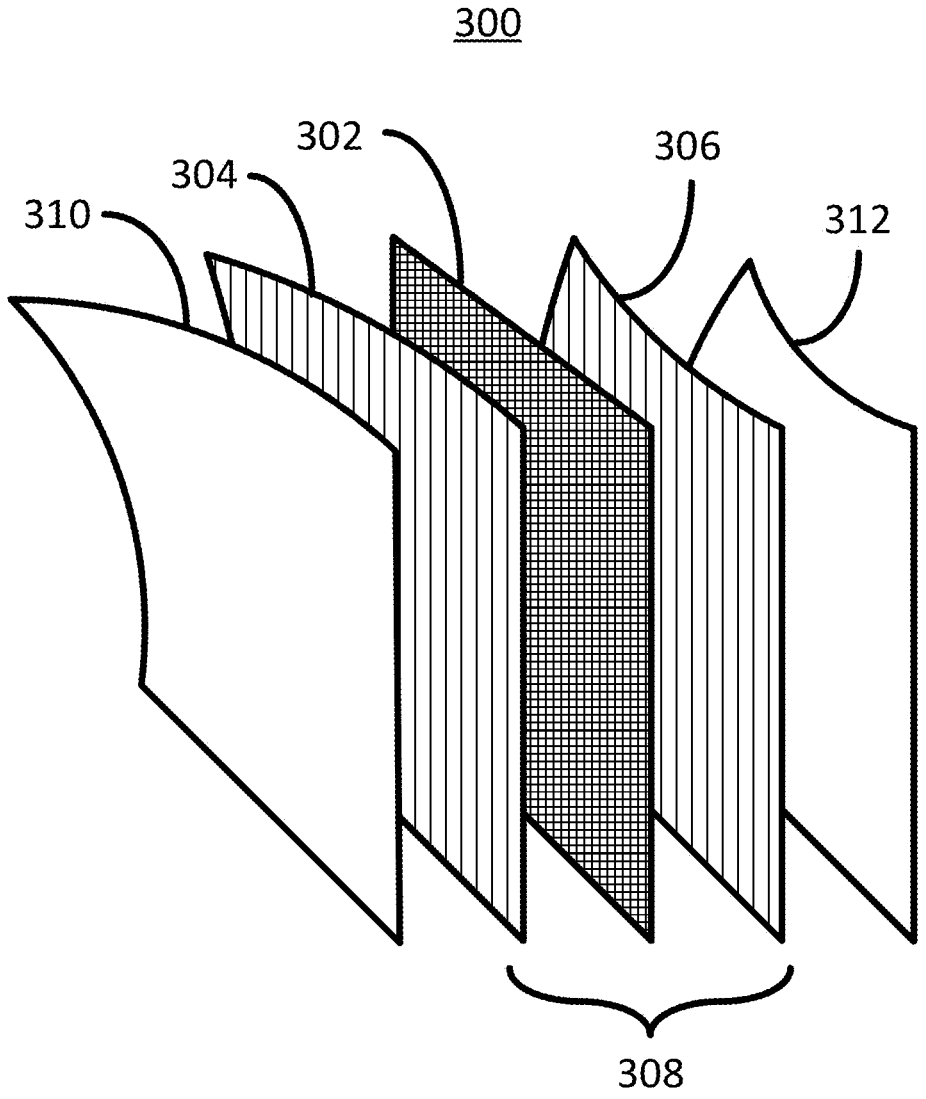
FIG. 3 is a line drawing of a five-ply filter panel consistent with the embodiments of the present invention.

The center panel 110 extends from the elastic waistband 102 at the underwear back/posterior side 150 (FIG. 1B), through the crotch region 130 and to the elastic waistband 102 at the underwear front side 140 (FIG. 1A). As shown in FIG. 3 in certain embodiments, the center panel 110 is a single layer of five-ply filter material 300 with an activated carbon fiber filter material 302 sandwiched between and bonded to both an inner layer of cotton fabric 304 and an outer layer of cotton fabric 306 that are all sandwiched between an inner layer of bamboo fabric 310 and an outer layer of bamboo fabric 312. In some embodiments, the bamboo fabric 310/312 is a bamboo rayon fiber textile, which when attached to the cotton and activated carbon fiber filter material 302, provides odor filtering and wicking superior to that of other filtration laminated textile arrangements. In the present embodiment, the center panel 110 comprises a single sheet of five-ply filter material 300, meaning that the center panel 110 is not formed from multiple sheets of five-ply filter material 300 sewn together. Other embodiments contemplate the center panel 110 having only a front panel 111*a* and a rear panel 111*b* that are sewn together at a rear transfer seam 113 at the crotch region 130. When sewn together, the front panel 111*a* and the rear panel 111*b* create a contiguous (single) center panel 110, wherein the center panel 110 passes through the crotch region 130. One embodiment of the five-ply filter material 300 contemplates the inner layer of cotton fabric 304 and an outer layer of cotton fabric 306 bonded to the activated carbon fiber filter material 302 via a spray on glue, which is then heated to create the bond. The cotton-carbon laminate 308 (cotton and activated carbon fiber laminate) can be sewn between the bamboo fabric 310/312 to provide added comfort to the wearer. One reason for the five-ply filter material 300 is because the glue and heat process of bonding may cause the bonding fabric to "carbonize" and become less comfortable to the wearer. Some embodiments envision replacing the cotton fabric layers 304/306 with bamboo fabric layers to create a bamboo-carbon laminate (same structure as element 308). Here, there is an inner and outer bamboo layer bonded directly to the activated carbon fiber filter material 302 via a spray on glue. The bamboo-carbon laminate (308) is sewn between the bamboo fabric 310/312 to provide added comfort to the wearer because the glue that is heated and bonded may be stiff and therefore uncomfortable to the wearer. The cotton-carbon laminate 308, or the bamboo-carbon laminate (308), are irremovably integrated in the center panel 110, meaning that laminate 308 cannot be removed from the underwear 100 without tearing or otherwise destroying the underwear 100.

As shown in FIG. 1A, the center panel 110 further comprises a crotch dart 122 that is essentially an expansion joint that can expand outwardly to provide room for the male anatomy. The center panel 110 is interposed between the side panels 120 in a way that separates the side panels 120 from contacting one another. In other words, the center panel 110 separates the two side panels 120. In the present configuration, the underwear 100 is considered boxer briefs whereby the inner leg extension 134 is part of the side panel 120. The inner leg extensions 134 of both side panels 120 are not in contact because the center panel crotch portion 132, of the center panel 110, separates them (the inner leg extensions).

In the present underwear embodiment 100, the side panels 120 are envisioned as being a one-ply of bamboo fabric (meaning the side panels 120 consist of a one-ply bamboo fabric that include nothing other than a one-ply bamboo fabric other than stitching). The one-ply of bamboo fabric can be the same bamboo rayon fiber textile that is used in the outer layers 310/312 of the five-ply center panel 110, except without any other layers of fabric bonded thereto, hence, one-layer. Certain embodiments contemplate the bamboo fabric side panels 120 being the same type of bamboo material as the outer layers 310/312 of the five-ply center panel 110 but with a different thickness, such as a thicker bamboo fabric, for example. In certain embodiments, each side panel 120 can be constructed with a seam sewn along the underwear side 104 and at the inner leg portion 134. While other embodiments contemplate each side panel 120 being constructed from a single sheet of bamboo material with no seam sewn along the underwear side 104.

In the underwear embodiment 100, the center panel 110 flares outwardly from the center panel crotch region 132 (in the direction of) to the waistband 102 in the underwear front 140, as shown in FIG. 1A. More specifically, in the underwear front 140, the narrowest portion of the center panel 110 is in the center panel crotch region 132 and the widest point of the center panel 110 is where it meets the waistband 102 at the waistband seam 118. In the present embodiment, the center panel 110 is convex shaped at the front side panel interface 112 (front center-to-side panel seam). However, other embodiments envision the front side panel interface 112 being a straight line or optionally the center panel 110 being concave shaped at the front side panel interface 112.

As shown in FIG. 1B, the center panel 110 flares outwardly from the center panel crotch region 132 to the waistband seam 118 in the underwear back/posterior 150. In the present embodiment, the center panel 110 is convex shaped at the rear side panel interface 113 (rear center-to-side panel seam). In certain embodiments, the rear side panel interface 113 tracks over, or otherwise traverses, a person's buttocks apex, shown here as target 136. The buttocks apex is defined as to top or highest part of the buttocks as viewed when a person (owner of the buttocks) is lying on their stomach. In some other embodiments, the rear side panel interface 113 does not track over a person's buttocks apex 136, but rather closer to the underwear sides 104. In the present embodiment, the center panel 110 comprises a broader wedge shape in the rear side 150 than the front side 140. Accordingly, the length of the waistband seam 118 at the waistband 102 in the center panel 110 is larger in the rear side 150 than the front side 140 (FIG. 1A), as shown.

Figure 1C:
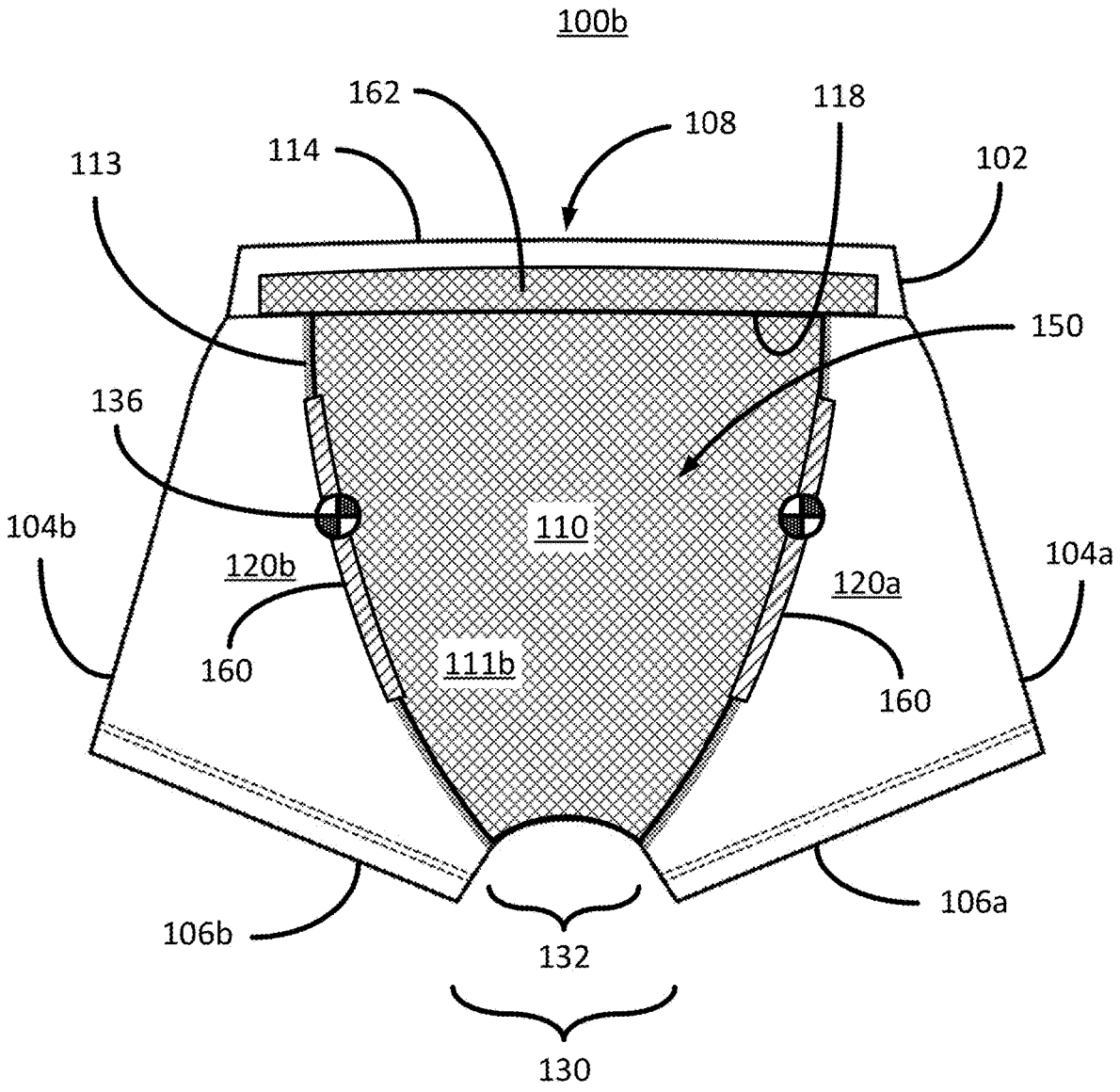
FIG. 1C is a line drawing of a back view of yet another underwear embodiment consistent with embodiments of the present invention.

FIG. 1C is a line drawing of a back view of yet another underwear embodiment consistent with embodiments of the present invention. FIG. 1C is a boxer brief embodiment 100*b*, which is similar to the underwear embodiment 100 of FIGS. 1A and 1B but with a couple of modifications. In this boxer brief embodiment 100*b*, an elastic seam band 160 is sewn into the seam of the rear side panel interface 113 (on both sides). In this embodiment, the elastic seam band 160 takes up a portion of the rear side panel interface 113, however other embodiments envision the elastic seam band 160 extending along the entirety of the rear side panel interface 113. Here, the elastic seam band 160 resides at (or in the vicinity of) the buttocks apex 136. Certain embodiments further envision the elastic seam band 160 residing at least along a portion of the front side panel interface 112 (not shown in FIG. 1C). Other embodiments envision a plurality of elastic seam bands 160 dispersed along the rear side panel interface 113, the front side panel interface 112 or both. The elastic seam band 160 can improve the contact of the underwear 100*a* on the wearer's body especially at the front side panel interface 113 and/or rear side panel interface 112, thereby improving carbon filtering of flatulence/gas through the center panel 110.

Another embodiment of the present invention as shown in FIG. 1C envisions waistband carbon filter material 162 integrated in the waistband 102. The waistband carbon filter material 162 is envisioned to improve additional filtering of flatulence at the baseband 102. Waistband carbon filter material 162 can be part of the center panel 110 extending into the waistband 102, or optionally, an independent piece of carbon filter material 162, shown here along the waistband seam 118. The carbon filter material 162 can be a five-ply filter material 300, a three-ply carbon filter material, simply carbon filter material or some other carbon filter material arrangement. The baseband carbon filter material 162 can be sandwiched in the waistband 102, or optionally can be attached to the inner or outer surface of the waistband 102.

Figure 2A:
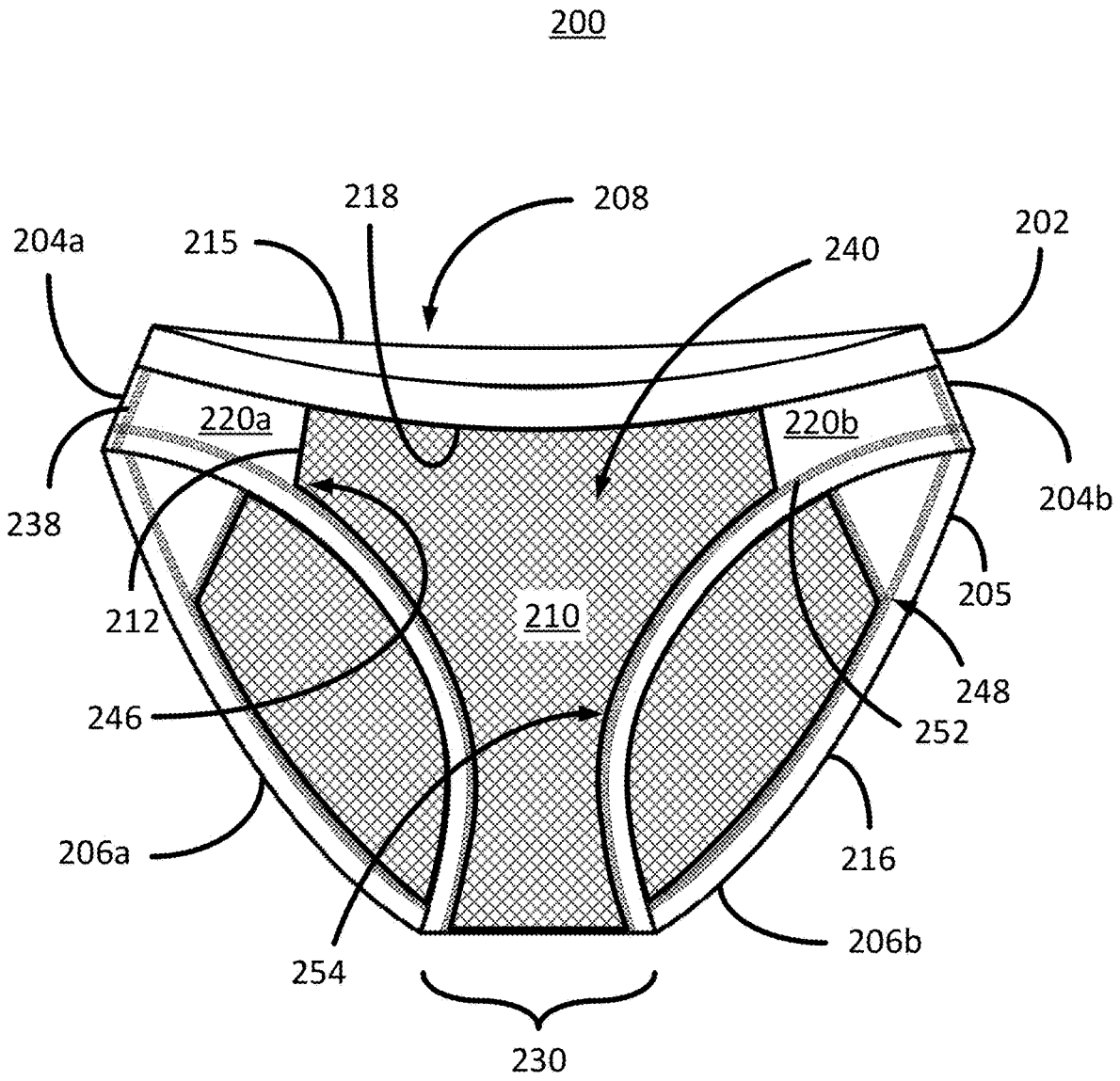
FIGS. 2A and 2B are line drawings of front and back views of a bikini style underwear embodiment consistent with embodiments of the present invention.
Figure 2B:
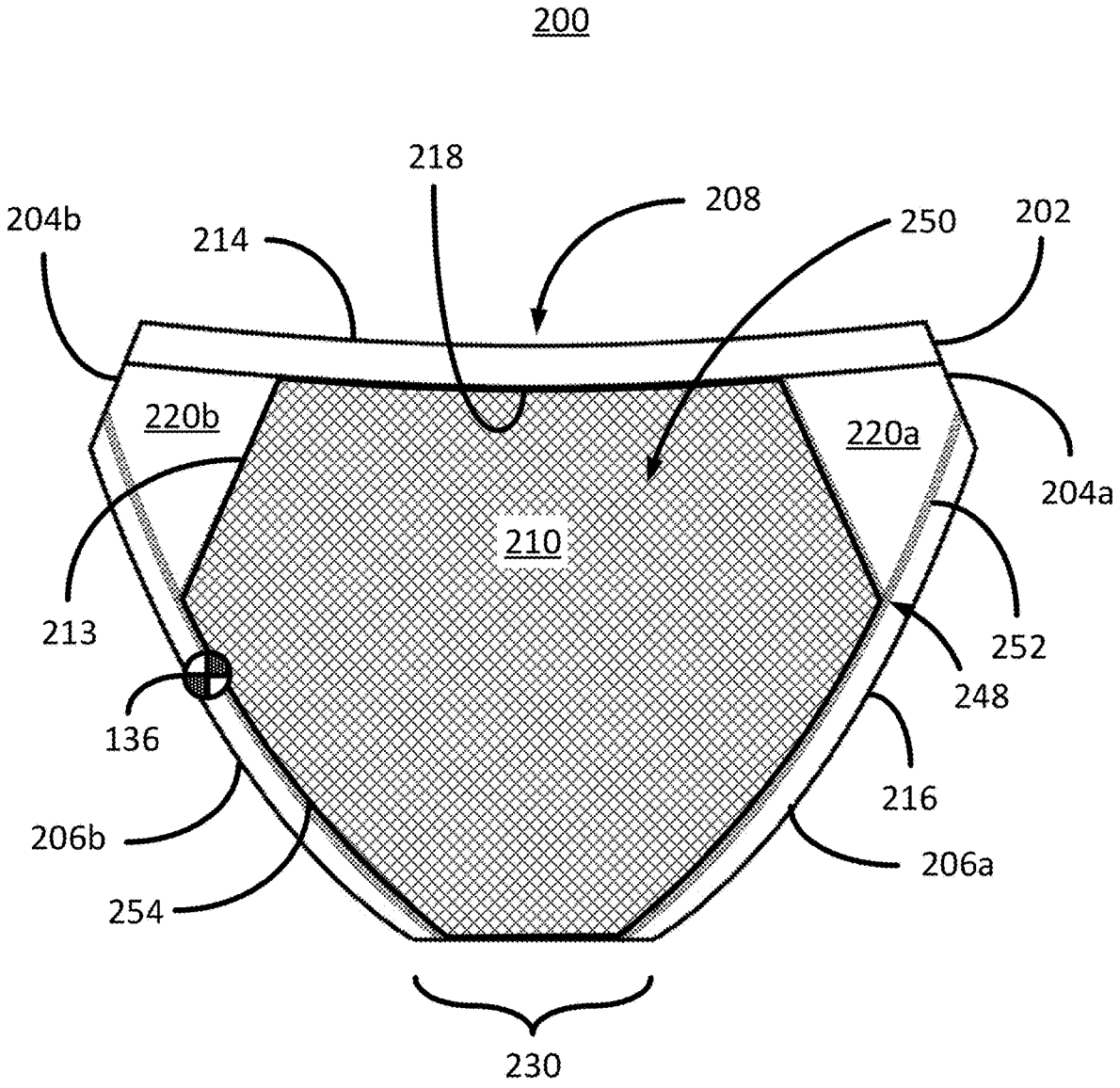

FIGS. 2A and 2B are line drawings of front and back views of a bikini style underwear embodiment (that is intended to be worn by females) consistent with embodiments of the present invention. As shown in FIG. 2A, the underwear embodiment 200 generally comprises a waistband 202 that is sewn to a bikini body 205. The biking body 205 generally comprises a center panel 210 and two side panels 220*a* and 220*b*, which generically are considered element 220. The bikini open edge 215 of the waistband 202 defines the bikini waist opening 208 of the bikini style underwear 200. The bikini body 205 extends between the bikini waist opening 208 and two leg openings 206*a* and 206*b*, generically considered element 206. The leg openings 206 are defined by corresponding leg cuffs 216, which in one embodiment is a folded over one-ply bamboo fabric. Other embodiments envision the leg cuffs 216 further comprising an elastic band (not shown) inside/between each folded over one-ply bamboo leg 216.

The bikini style underwear 200 are geometrically defined by two bikini sides 204*a* and 204*b*, a bikini front 240 (FIG. 2A) and a bikini back 250 (FIG. 2B), a bikini waist opening 208 and a bikini crotch region 230 that separates the leg openings 206. As shown in the present embodiment, there is no gusset in the bikini crotch region 230, which is defined by the center panel 210 (which is a five-ply filter material 300) and the leg cuffs 216. However, certain embodiments can include a gusset in the crotch region 230. The center panel 210 at the bikini front 240 extends along the center panel-to-cuff interface 254 at more than 50% of the leg cuffs 216 towards the bikini sides 204. In the present embodiment, the center panel 210 extends along the center panel-to-cuff interface 254 along and adjacent to the leg cuffs 216 at about 66%+/−5% of the leg openings 206 in the bikini front 240. By 'along and adjacent to' it is meant that the center panel 210 interfaces with, and is connected to, the leg cuffs 216 by way of a leg cuff seam 252. In the present embodiment, the center panel 210 extends from the leg cuff seam 252 towards the waistband 202 where the center panel 210 is sewn to the waistband 202 at the waistband interface 218 in the bikini front 240. The center panel 210 separates the one-ply side panels 220 so that they are not contiguous, or otherwise immediately adjacent or next to one another. As shown, the center panel 210 transitions from the leg cuff seam 252 towards the waistband 202 at essentially a sharp angle 246, which in this embodiment is approximately 110°, but in certain embodiments is envisioned to be between 80° and 140°. A 'sharp angle' is defined as two sides (besides being straight lines, arched, or some combination) that form the angle where they meet at an apex (point) as opposed to meeting at a curve that transitions to the two sides. The side panel leg cuff seam 252 includes the center panel-to-cuff interface 254 where the center panel 210 meets the leg cuff 206.

In the present embodiment, the front panel 210 extends from the waistband interface 218 at the bikini front 240 (FIG. 2A) to the waistband interface 218 at the bikini back 250 (FIG. 2B). With regards to the bikini back 250 of FIG. 2B, the center panel 210 extends along more than 50% of the leg cuffs 216 towards the bikini sides 204. In the present embodiment, the center panel 210 extends along and adjacent to the leg cuffs 216 at about 66%+/−5% of the leg openings 206 in the bikini back 250. The center panel 210 extends from the leg cuff seam 252 from a center panel-to-cuff interface 254 towards the waistband 202 where the center panel 210 is sewn to the waistband 202 at the waistband interface 218 in the bikini back 250. As shown, the center panel 210 transitions from the center panel-to-cuff interface 254 of the leg cuff seam 252 to the side-to-center panel interface 213 towards the waistband 202 at essentially a sharp angle 248, which in this embodiment is approximately 125°. Some embodiments envision the center panel-to-cuff interface 254 to the side-to-center panel interface 213 to be between 100° and 170°. As shown in FIG. 2A, there is no non-filter material (i.e., there is no one-ply bamboo fabric) between the center panel 210 and the leg cuffs 216 at the center panel-to-cuff interface 254. In the present embodiment, the leg cuffs 216 traverse a person's buttocks apex 136 somewhere along the center panel-to-cuff interface 254. Other embodiments envision neither the leg cuff 216 nor the center panel-to-cuff interface 254 traversing a person's buttocks apex 136 (FIG. 2B). Still, other embodiments envision that no part of the center panel-to-cuff interface 254 or the center-to-side panel interface 213 traversing a person's buttocks apex 136. Here, the center-to-side panel interface 213, which is defined by the attachment seam of the bikini side panel 220 to the center panel 210, is essentially a straight line. In the present embodiment, the bikini side panels 220 are each formed of two pieces of one-ply bamboo fabric connected by a bikini side seam 238. However, other embodiments contemplate the bikini side panels 220 being a single panel/piece of one-ply bamboo fabric. In this embodiment, the bikini sides 204 are between 1 inch and 3 inches as defined from the bikini open edge 215 to each bikini leg opening 206 (which is the shortest distance between the bikini open edge 215 and the bikini leg opening 206).

Figure 2C:
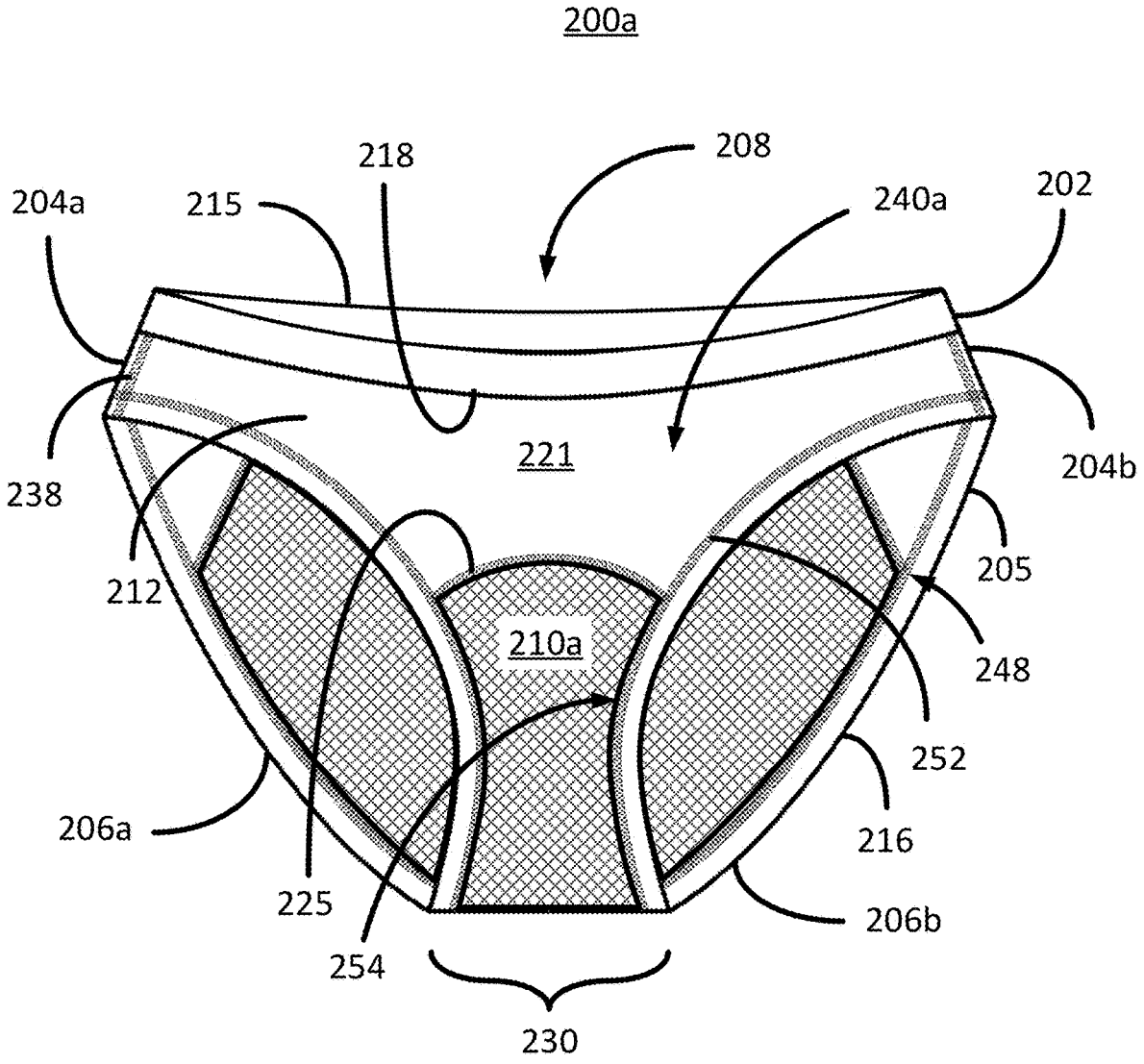
FIG. 2C is a line drawing of the front view of a bikini style underwear embodiment consistent with embodiments of the present invention.

FIG. 2C is a line drawing of the front view of a bikini style underwear embodiment consistent with embodiments of the present invention. The bikini style embodiment 200*a* is similar to the bikini style embodiment 200 of FIGS. 2A and 2B but with a different bikini front 240*a*. The bikini style embodiment 200*a* has the same bikini back 250 as the bikini style embodiment 200. This bikini front embodiment 200*a* differs from the bikini front embodiment 200 in that the center panel 210*a* at the bikini front 240*a* extends along towards the bikini sides 204 less than 50% of the leg cuffs 216 where they terminate between the bikini crotch region 230 and the waistband 202, but not at the waistband 202. In the present embodiment, the center panel 210*a* extends along and adjacent to the leg cuffs 216 at about 50%+/−10% of the leg openings 206 in the bikini front 240*a*. The center panel 210*a* extends from the leg cuff seam 252 at the center panel-to-cuff interface 254 towards the waistband 202, however the center panel 210*a* is sewn to a one-ply bamboo front panel 221 at front-to-center panel interface 225. There is no non-filter material (i.e., one-ply bamboo fabric) between the center panel 210 and the leg cuffs 216 at the center panel-to-cuff interface 254. The front panel 221 extends uninterruptedly from the left bikini side 204*a* to the right bikini side 204*b*. In the present embodiment, the center panel 210*a* is convex shaped at the front-to-center panel interface 225.

The embodiments presented in conjunction with FIG. 1C can equally be applied to the bikini underwear embodiments 200 and 200*a* of FIGS. 2A-2C, without departing from the scope and spirit of the present invention. Certain embodiments of the present invention distinguish themselves from embodiments of the prior art in that the activated carbon fiber filter material 302, the cotton fabric 304/306 the bamboo fabric 310/312 are non-polyamide fabrics, but rather all natural fabrics, which have superior breathability and filtering capability than polyamide fabrics. The underwear body 205 is permeable to air/gas and vapor, meaning that both gas and vapor exchange will occur through the center panel 110 and the side panels 120.

FIGS. 4A-4L are line drawings of another odor control underwear embodiment and adsorbent sleeve consistent with embodiments of the present invention. These odor control underwear embodiments depict an underwear system that generally includes an underwear comprising a pocket that is fit for accommodating a removable activated carbon adsorbent sleeve. Accordingly, after at least one use (i.e., a time of wearing the underwear system), the adsorbent sleeve can be removed from the accommodating pocket, and therefore the underwear, whereby the adsorbent sleeve can be washed, dried, and reinserted in the accommodating pocket for another underwear use.

Figure 4A:
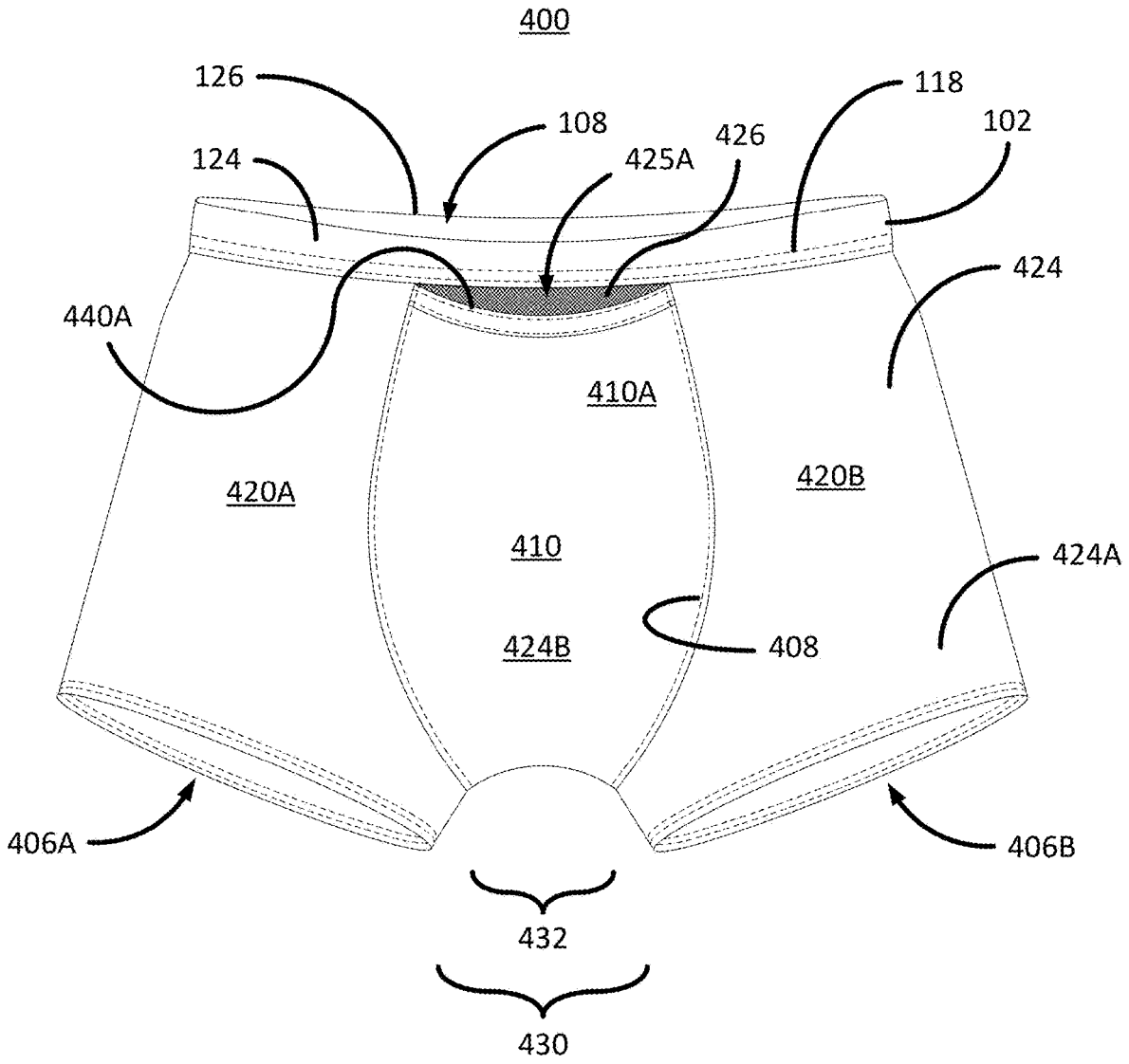
FIGS. 4A-4L are line drawings of another odor control underwear embodiment and adsorbent sleeve consistent with embodiments of the present invention.
Figure 4B:
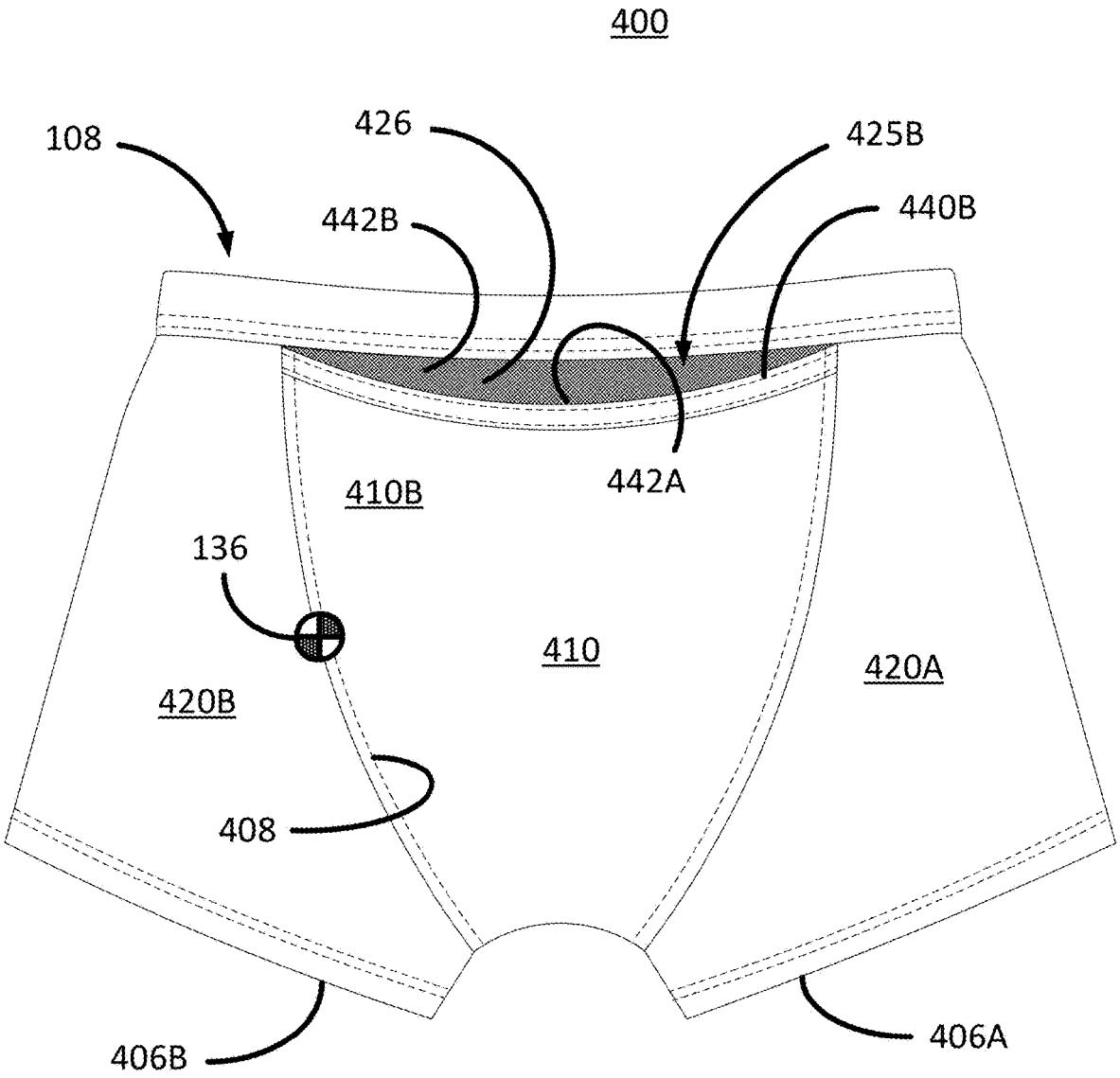
Figure 4C:
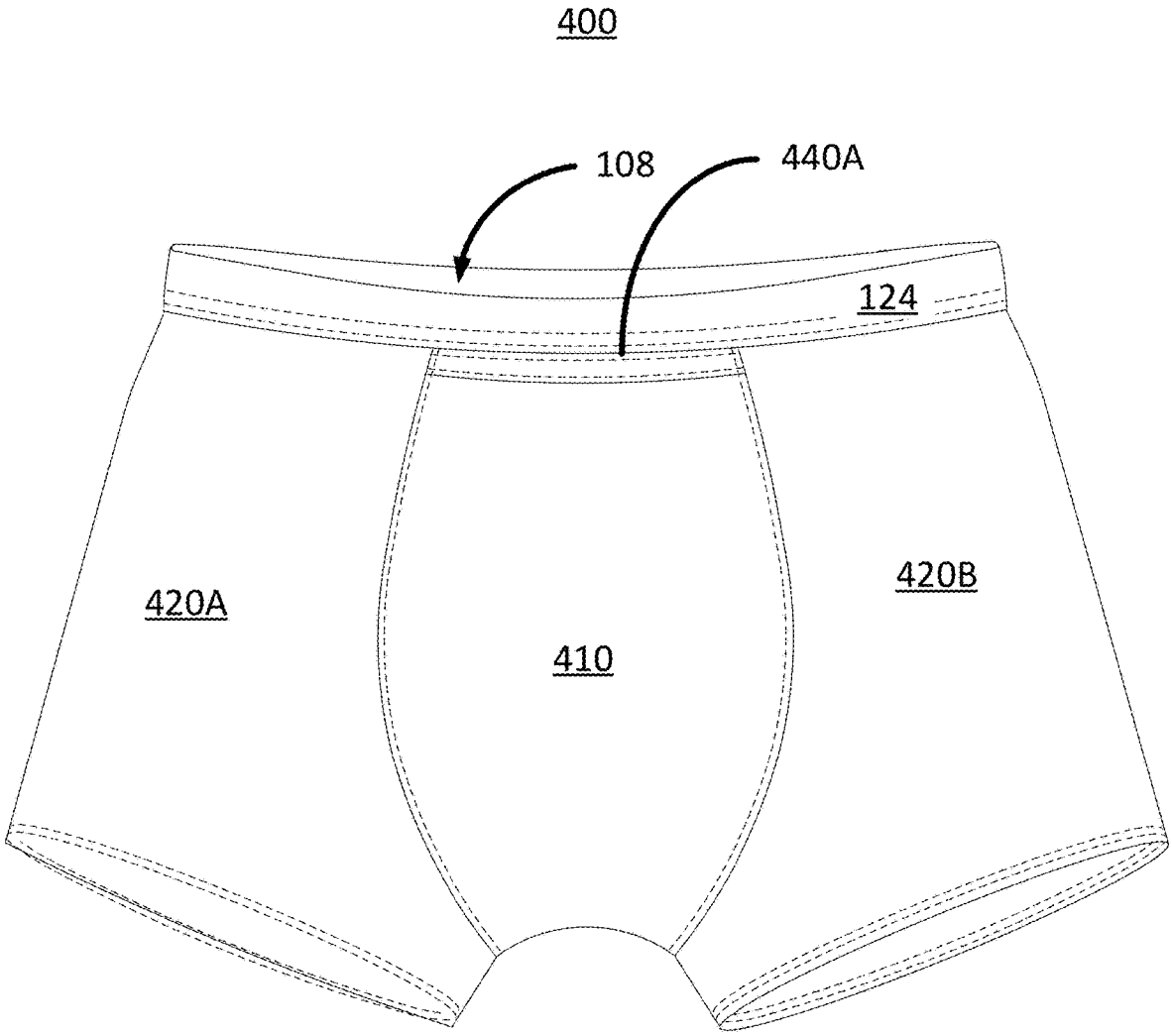
Figure 4D:
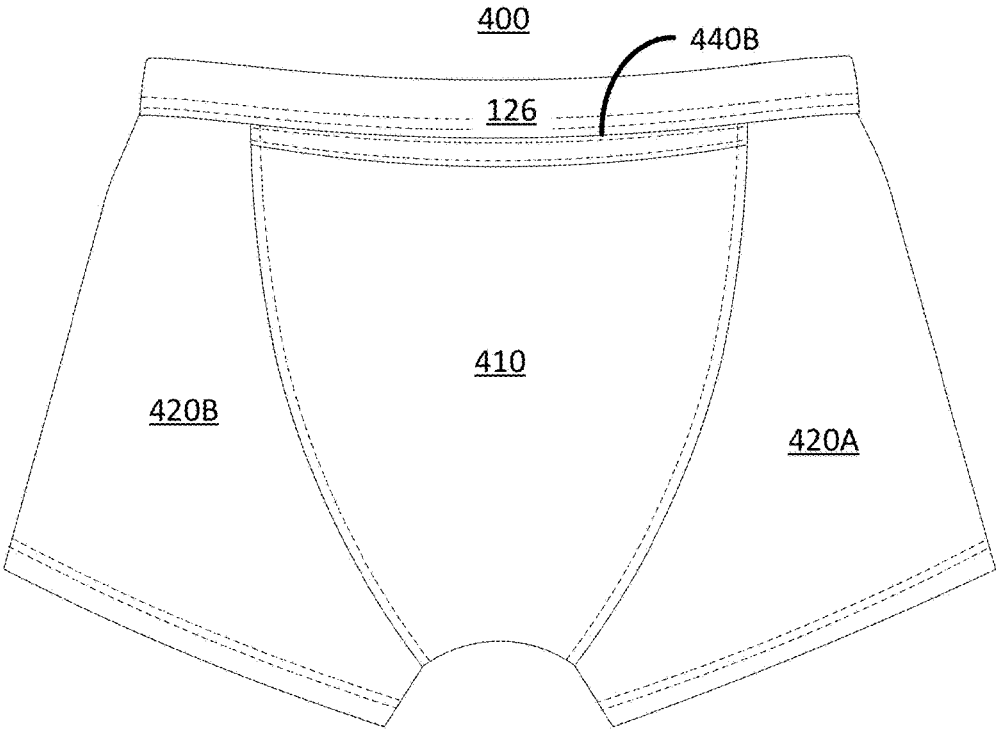
Figure 4E:
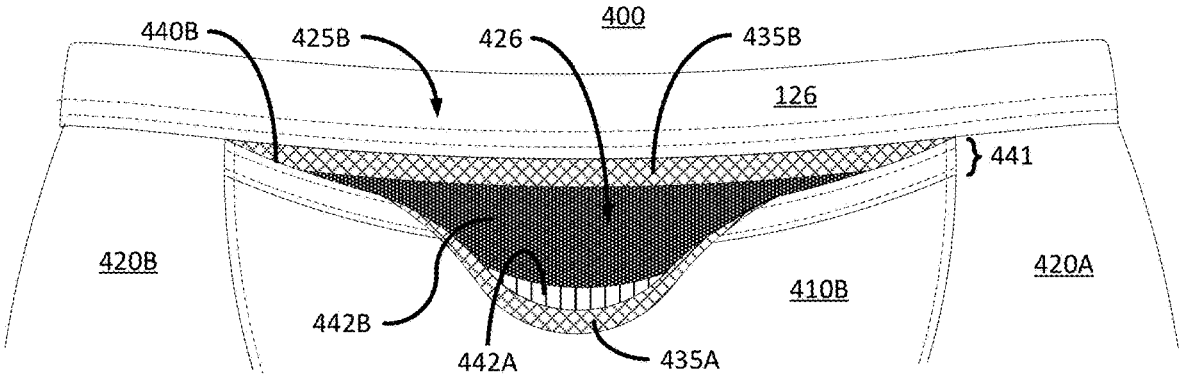
Figure 4F:
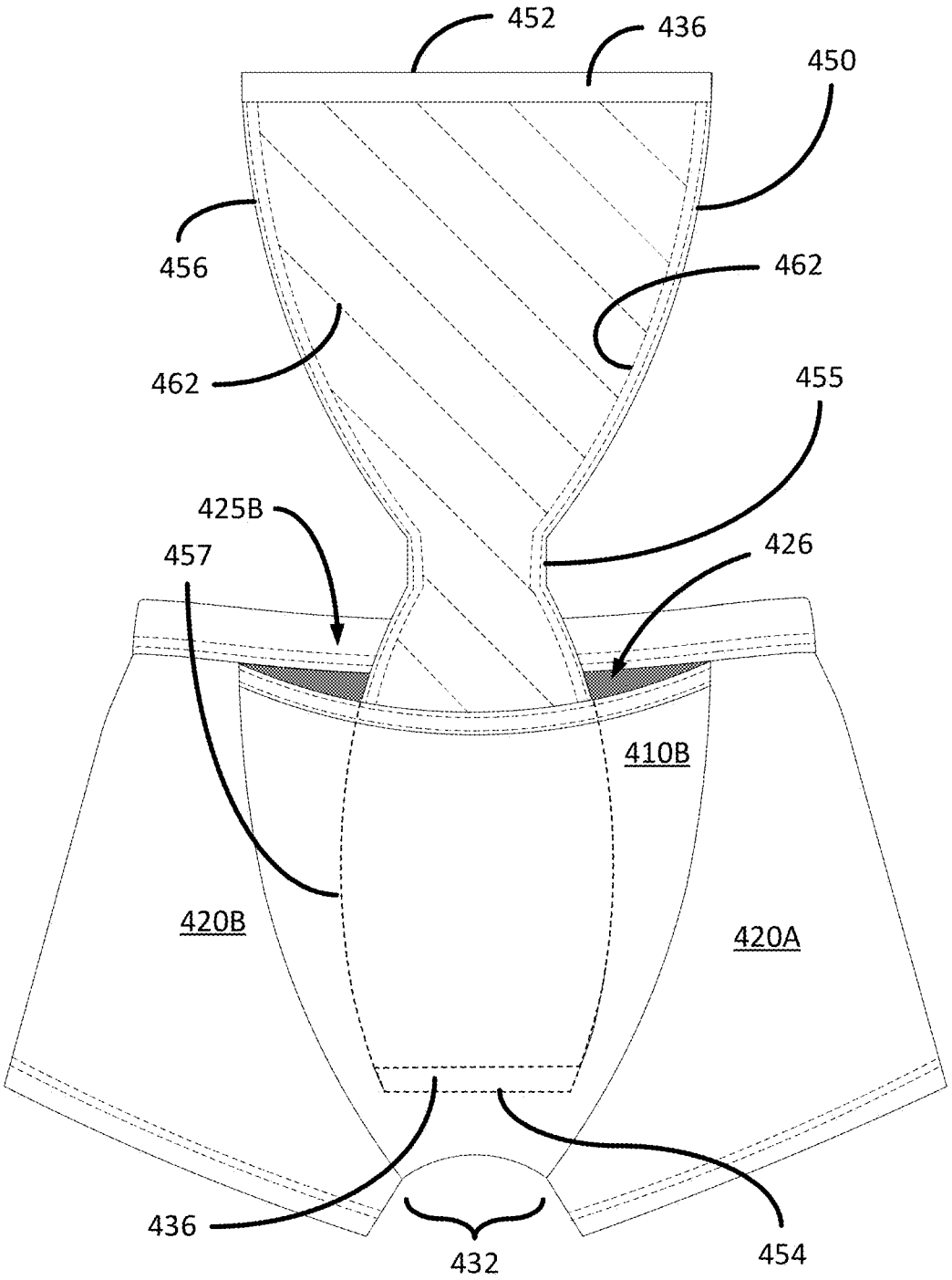
Figure 4G:
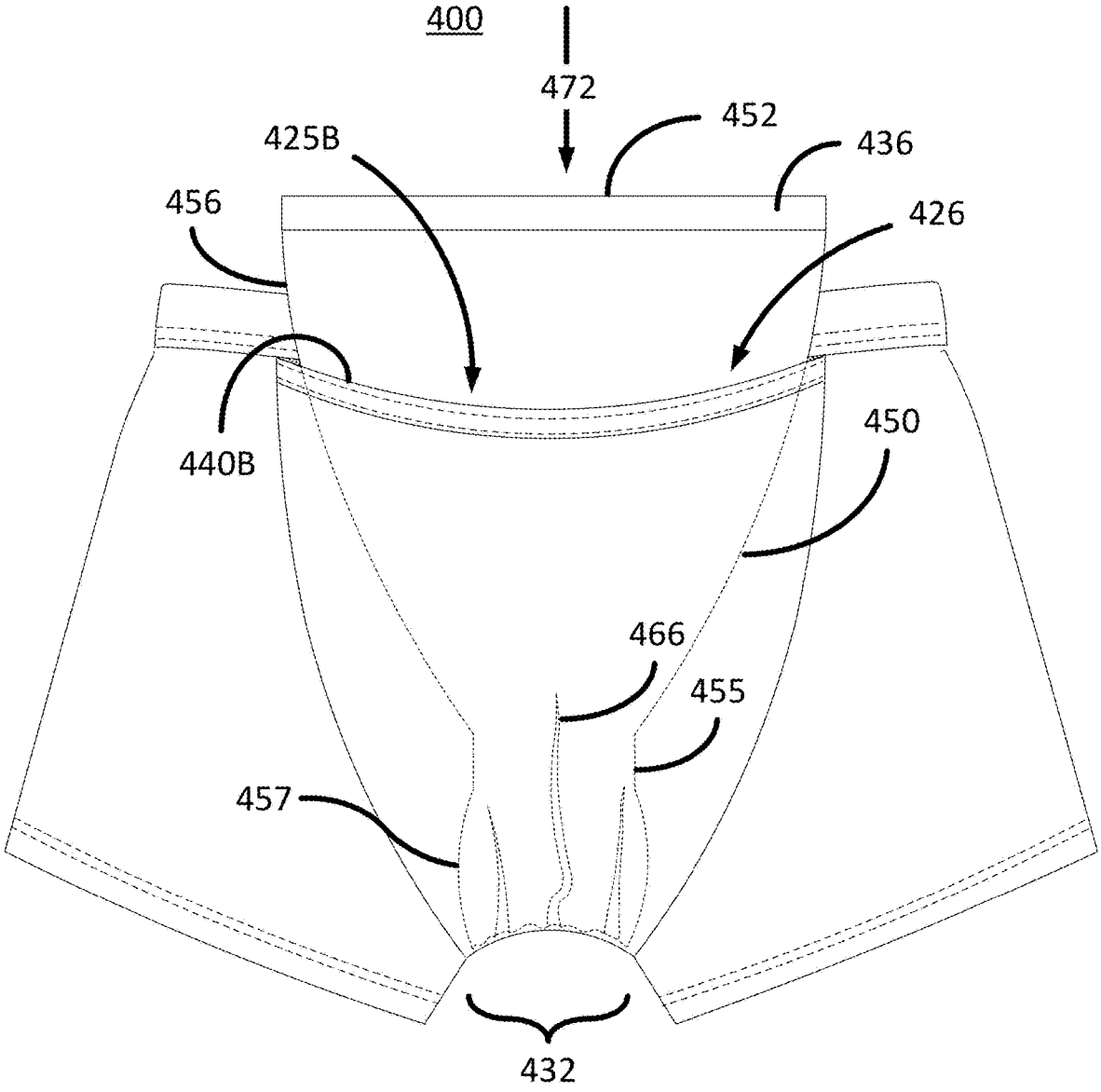
Figure 4H:
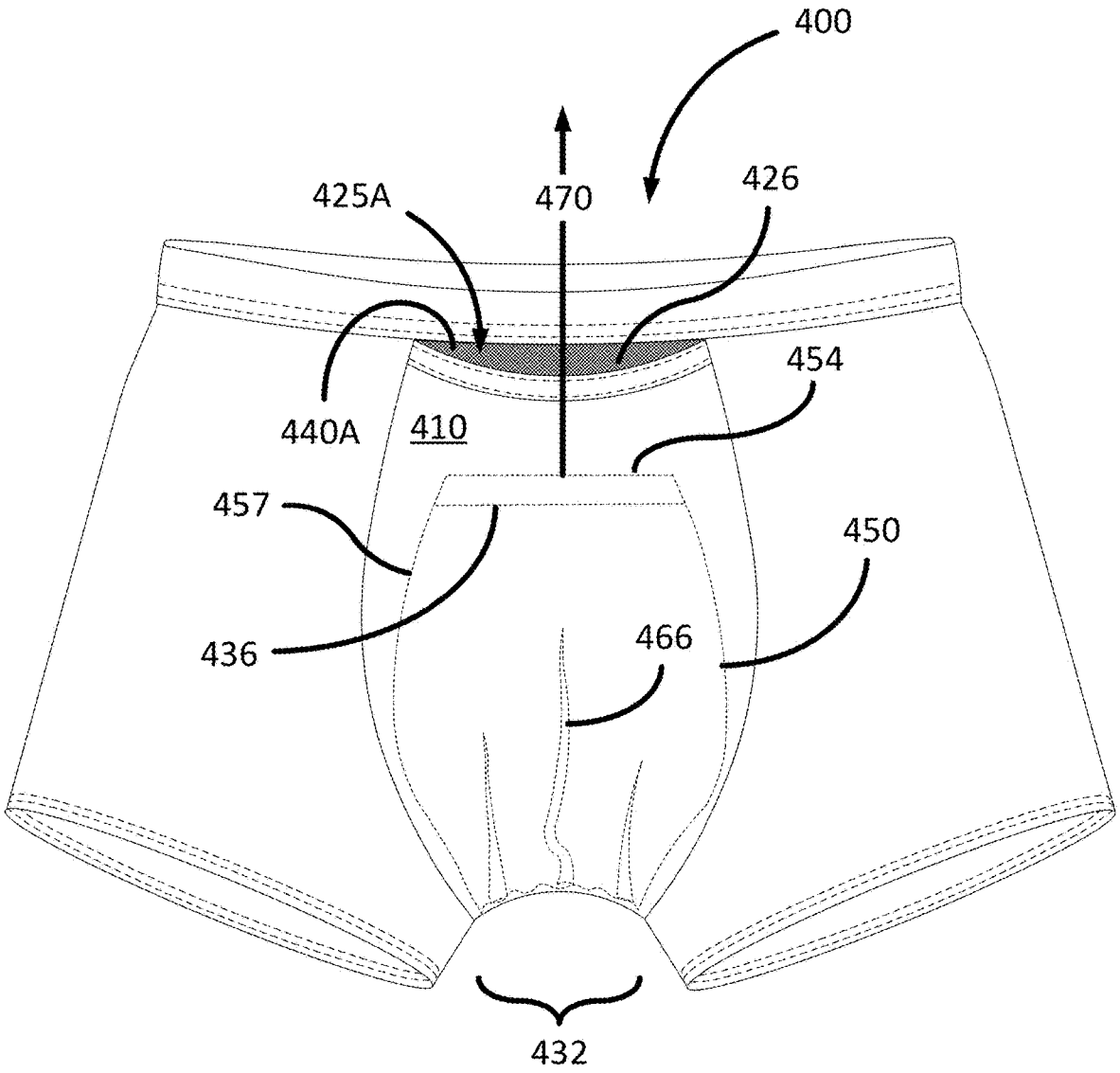
Figure 4I:
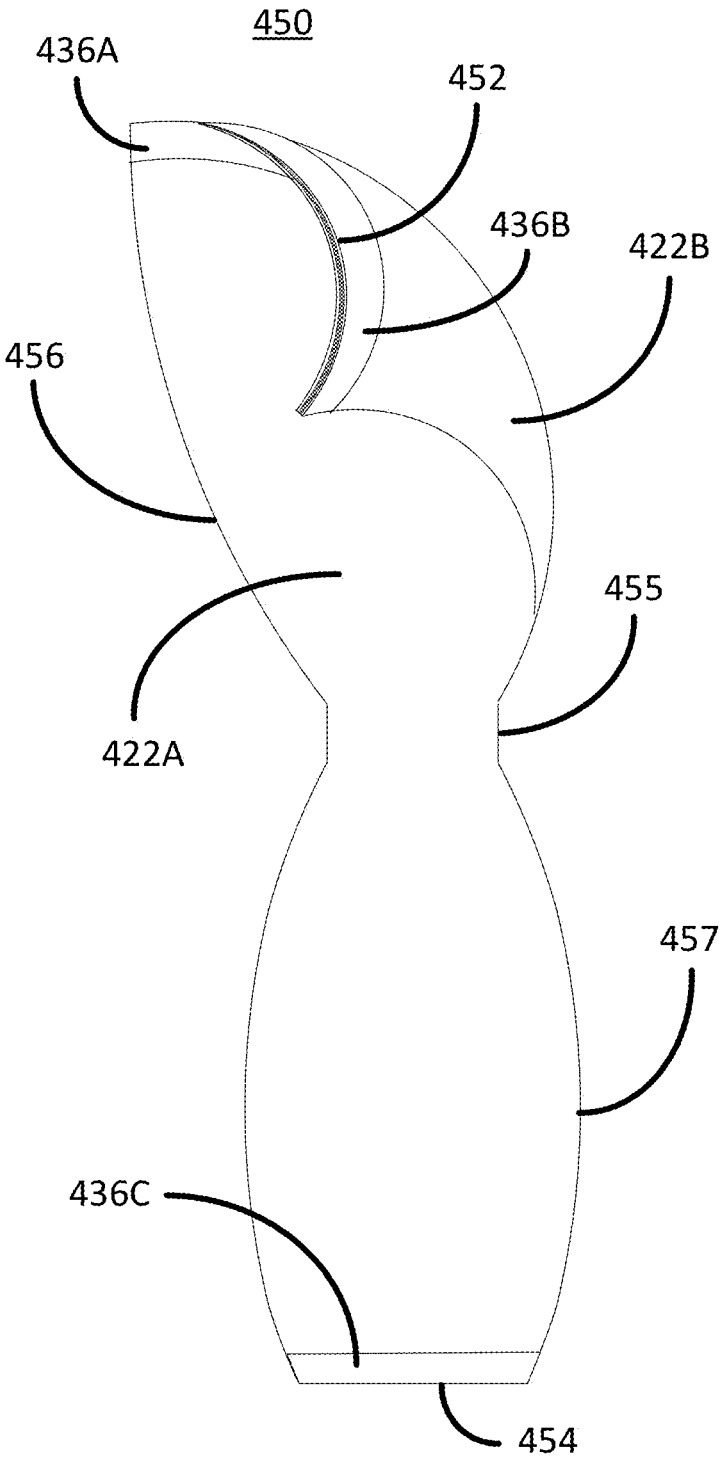

FIG. 4A illustratively depicts a front side of an odor control underwear embodiment 400 (or simply underwear 400) with an adsorbent sleeve accommodating pocket 426 (or simply pocket) with a front access port 425A open to receive an adsorbent sleeve 450, as depicted in FIG. 4I. The underwear 400 extends between a waist opening 108 and two leg openings 406A and 406B. Also, the leg openings 406A and 406B, and other elements with letters indicating a sub-set of a common element, can be generically called-out as element 406, meaning a leg opening 406 could be either leg opening 406A and 406B and leg openings 406 can refer to both leg openings 406A and 406B. This logic is used throughout the disclosure. In this embodiment, the underwear 400 includes the side panels 420A and 420B, the center panel 410 and all connective stitching, such as the front side panel interface 408 (i.e., seams) that fixedly connect the panels 420 and 410 together. An inseparable unitary elastic waistband 102 defines the waist opening 108. The inseparable unitary elastic waistband 102 is sewn to the side panels 420 and an inner ply 442B of the center panel 410 at waistband seam 118, as called out in FIG. 4B. Certain embodiments contemplate the side panels 420A and 420B being a single-ply fabric 424A. Some embodiments of fabric 424 include a bamboo fabric that is over 90% bamboo with cotton and/or spandex. Certain embodiments envision between 3%-5% spandex.

The underwear garment 400 is geometrically defined by the two side panels 420A and 420B, the underwear front center panel 410A, which generically is element 410 for the center panel and the underwear back center panel 410B, of FIG. 4B. The underwear waist opening 108, and a crotch region 130 that separates the leg openings 106. As shown, the underwear crotch region 430 is defined as the material between each of the leg openings 406. The center panel 410 is a two-ply fabric 424B that defining a pocket 426 between two-ply fabric 424B. The pocket 426 is inside of the underwear garment 400. Some embodiments contemplate the two-ply fabric 424B being the same fabric material as the single-ply fabric 424A. The center panel 410 comprises a center panel crotch 432 that is defined in the crotch region 430. The pocket 426 extends uninterrupted through the center panel crotch 432 thereby defining a continuous pocket from essentially the front pocket lip 440A to the rear pocket lip 440B. One skilled in the art will appreciate that certain embodiments may have attachment elements, such as a hook and loop fabric generically known as VELCRO® Brand hook and loop fasteners, that might shorten the continuous pocket 426 from reaching exactly the lips 440A and 440B, hence the 'essentially' terminology. Other embodiments contemplate attachment elements being snaps, hooks, buttons, zippers, etc. known to those skilled in the art. The leg openings 406 could include a leg cuff 116, as shown in FIG. 1A. As shown, the front center panel 410A comprises a front access port 425A defined between the waistband front 124 and a front pocket lip 440A. FIG. 4A depicts the front access port 425A opened revealing the inside of the pocket 426.

FIG. 4B illustratively depicts a rear view of the underwear 400 with a rear access port 425B of the pocket 426 open to receive an adsorbent sleeve 450. For reference, the rear view of the underwear 400 calls out certain labels described in conjunction with FIG. 4A, as shown. The major difference between the front and rear view of the underwear 400 is that the rear center panel 410B is wider to cover a wearers back-side. More specifically, the rear center panel 410B is wider with stitching 408 that tracks over, or otherwise traverses, a person's buttocks apex, shown here as target 136. The rear pocket 426 depicts the rear access port 425B opened showing the center panel rear inner ply 442B separated from the front outer ply 442A on the inner side of the rear lip 440B.

FIGS. 4C and 4D illustratively depict the front and back views of the underwear 400 with the front access port 425A and the rear access port 425B of the pocket 426 closed, respectively. As shown in FIG. 4C the front pocket lip 440A is closed right under, or essentially at, the waistband front 124 thereby sealing the front access port 425A. Likewise, as shown in FIG. 4D the rear pocket lip 440B is closed right under, or essentially at, the waistband rear 126 thereby sealing the rear access port 425B. This is accomplished with the adsorbent sleeve 550 inserted and the NCC strips 535 and 536 engaged, as discussed below.

FIG. 4E illustratively depicts a rear view of the underwear 400 at the rear access port 425B with the rear lip 440B flipped over to reveal an outer NCC strip 435A attached to the outer ply layer inner surface 442A. In this embodiment, the outer NCC strip 435A is sewn to the lip area 441 at the interface of the rear panel 410B and rear lip 440B. Also as shown, an inner NCC strip 345B is attached to the inner ply layer surface 442B. Certain embodiments entertain the idea that the outer underwear NCC strip 435A and the inner underwear NCC strip 345B are the same binary side that will not stick together, such as the outer NCC strip 435A being a loop side and the inner NCC strip 345B also being a loop side, for example. In this embodiment, the inner NCC strip 345B and outer NCC strip 435A are the soft loop side of NCC. Other embodiments envision the inner NCC strip 345B and outer NCC strip 435A being the rougher/stiffer hook side of NCC.

FIGS. 4F-4H illustratively depict inserting an adsorbent sleeve 450 into the pocket 426 consistent with embodiments of the present invention. FIG. 4F (in view of FIGS. 4G and 4H) shows the narrow sleeve end 457 of the adsorbent sleeve 450 partially disposed in the underwear's back center panel 410B. In this embodiment, the adsorbent sleeve 450 is hourglass shaped with a narrow front sleeve segment 457 sized to conform to the pocket region of the front center panel 410A, a crotch segment 455 sized to conform to the pocket region of the center panel crotch 432, and a wide rear sleeve segment 456 sized to conform to the pocket region of the rear center panel 410B. The adsorbent sleeve 450 is a multi-ply carbon filter sleeve that is sewn together via side seams and center stitching 462. There are adsorbent sleeve NCC strips 436 attached at each end 452 and 454 of the adsorbent sleeve 450. The adsorbent sleeve NCC strips 436 are opposite binary sides relative to the underwear NCC strips 435, to facilitate a bonding connection. In other words, if the underwear NCC strips 435 are loops then the adsorbent sleeve NCC strips 436 are hooks. As shown here, a user manually inserts the sleeve second end 454 through the rear access port 425B and pushes the sleeve 450 towards and into the center panel crotch pocket region of the center panel crotch 432.

FIG. 4G depicts the adsorbent sleeve 450 being pushed further into the pocket 426 from that which is shown in FIG. 4F, as indicated by the arrow 472. As shown, the sleeve 450 is almost entirely in the pocket 426. A person inserting the sleeve 450 will have to deform the sleeve 450 to get through the center panel crotch area 432, as shown by the creases 466 in the sleeve 450, because the front segment of the sleeve 457 is wider than the crotch area 432. When installed, the adsorbent sleeve NCC strips 436 at the front and back surfaces 422A and 422B of the sleeve first end 452 (of FIG. 4I) will line up (be aligned) with the underwear NCC strips 435A and 435B at the rear pocket lip 440B. The rear access port 425B is sealed shut by pressing the underwear NCC strips 435 against the adsorbent sleeve NCC strips 436. As previously mentioned, the underwear NCC strip 435 is the adhering mate to the adsorbent sleeve NCC strip 436. In one embodiment, the underwear NCC strip 435 is the soft NCC loop side and the adsorbent sleeve NCC strip 436 is the stiffer hooked side, wherein the underwear NCC strip 435 sticks to the adsorbent sleeve NCC strip 436 when cooperating in a matingly engaged relationship accomplished when the two mating strips 435 and 436 are aligned and pressed together (see FIG. 4D).

FIG. 4H depicts the placement of the adsorbent sleeve 450 from FIG. 4G but as viewed from the front side of the underwear 400. As shown, the adsorbent sleeve 450 is being pulled (see arrow 470) towards the front access port 425A. Certain embodiments envision a user putting their fingers through the front access port 425A to grip the adsorbent sleeve 450 at or near the sleeve second end 454. To install the adsorbent sleeve 450 in the underwear 400, the user pulls the adsorbent sleeve 450 to the front access port 425A aligning the underwear NCC strips 435 (at the front access port 425A) with the adsorbent sleeve NCC strips 436 (at the with the sleeve second end 454). The deformed sleeve front segment 457 is depicted by the creases 466 in the sleeve 450 at the center panel crotch area 432. When aligned, the adsorbent sleeve NCC strips 436 at the front and back surfaces 422A and 422B of the sleeve second end 454 seal the front access port 425A when the NCC strips 435 and 436 are pressed together (see FIG. 4C).

FIG. 1 illustratively depicts the adsorbent sleeve 450 being bent to show the sleeve front 422A and back 422B. An upper front adsorbent sleeve NCC strip 436A is attached on the sleeve front surface 422A along the sleeve first end (top) 452 and a lower front adsorbent sleeve NCC strip 436C is attached on the sleeve front surface 422A along the sleeve second end (bottom) 454. The bent over top end 422A shows an upper rear adsorbent sleeve NCC strip 436B attached on the sleeve back surface 422B along the sleeve first end (top) 452. Though not shown here but shown in FIG. 4K, there is a lower rear adsorbent sleeve NCC strip 436C attached on the sleeve rear surface 422B along the sleeve second end (bottom) 454. With respect to FIG. 4E, the upper front adsorbent sleeve NCC strip 436A is intended to matingly engage the outer underwear NCC strip 435A and the upper rear adsorbent sleeve NCC strip 436B is intended to matingly engage the inner underwear NCC strip 345B. When engaged, the adsorbent sleeve 450 acts as an intermediate medium to seal the respective access ports 425. In certain embodiments, the adsorbent sleeve 450 does not have a front surface or rear surface but rather a first surface and a second surface that may be interchangeable or otherwise swapped.

Figure 4J:
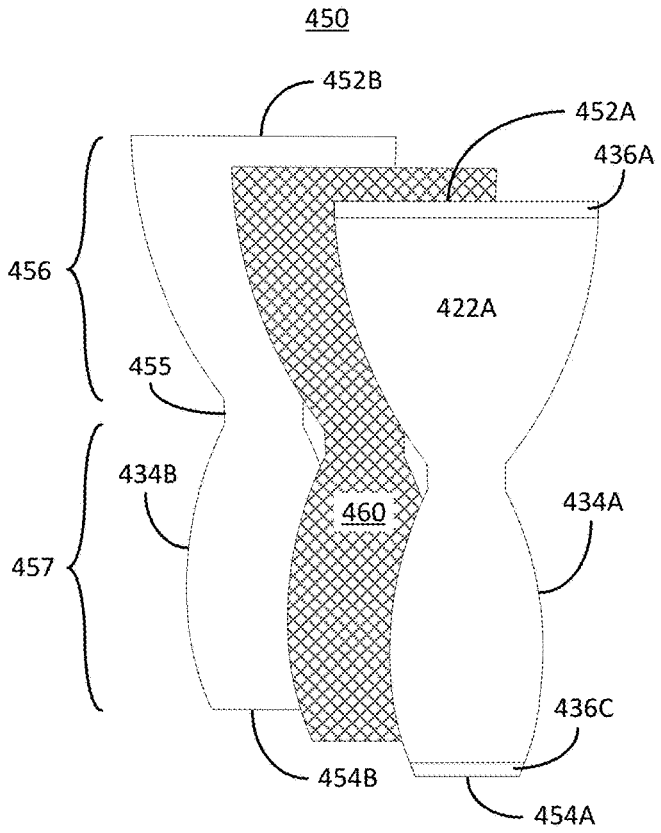
Figure 4K:
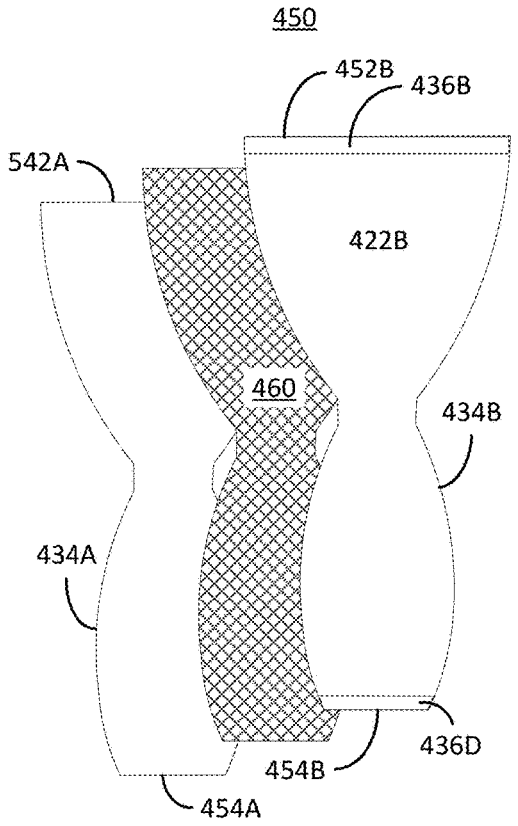

FIGS. 4J and 4K illustratively depict exploded views of an adsorbent sleeve embodiment 450 consistent with embodiments of the present invention. With respect to FIG. 4J, the adsorbent sleeve 450 comprises an activated carbon sheet 460 sandwiched between a pair of bamboo fabric sheets 434A and 434B. The bamboo fabric sheets 434A and 434B comprise greater than 50% bamboo and in some embodiments comprise greater than 90% bamboo. Certain other embodiments contemplate the bamboo sheet 434A and 434B having material that is identical to the single-ply fabric 424A used in the side panels 420A and 420B. As shown here, the sleeve front surface 422A of the front panel 434A has outwardly facing upper and lower front facing adsorbent sleeve NCC strip 436A and 436C. For reference, the sleeve back segment 456, the sleeve crotch segment 455 and the sleeve front segment 457 are shown along the rear panel 343B. FIG. 4K simply depicts the obverse of FIG. 4J with the rear panel 343B facing outward. As shown, the rear panel 343B comprises outwardly facing upper and lower rear facing adsorbent sleeve NCC strip 436B and 436D. Other elements a displayed with their callouts as described in conjunction with FIG. 4J. This three-ply adsorbent sleeve embodiment 450 can be connected with thread via seams 462, such as that shown in FIG. 4F. Other embodiments contemplate connecting the three sheets 422A, 422B and 460 via glue, staples or other attachment means understood by those skilled in the art.

Figure 4L:
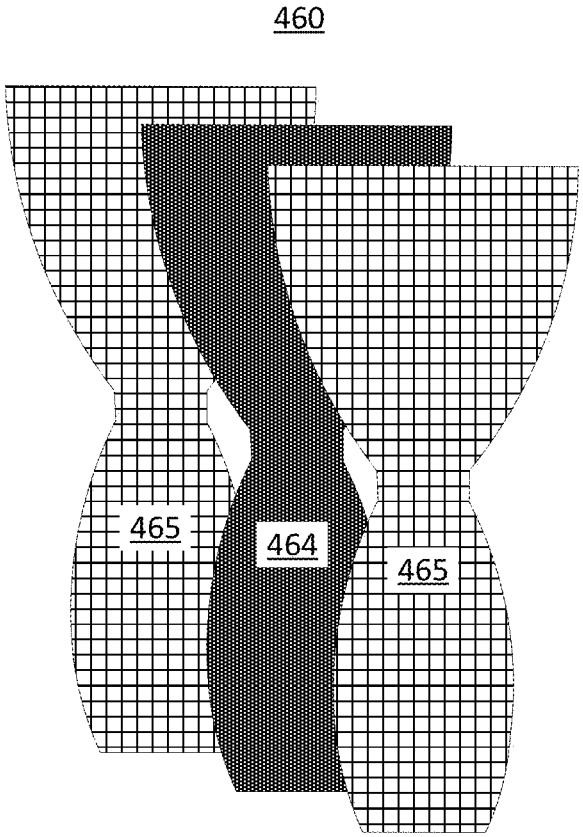

FIG. 4L illustratively depicts an activated carbon sheet embodiment 460 consistent with embodiments of the present invention. In this embodiment, the activated carbon sheet 460 can comprise a 1-3 mm carbon fiber felt 464 sandwiched between two sheets of cotton mesh 465 that can be adhered together via an adhesive or sewn together via thread, just to name a couple of examples. Certain other embodiments of an activated carbon sheet envision a double layer of carbon fiber felt 464. Still other embodiments of the present invention contemplate an activated carbon sheet being a fabric and not a felt.

Figure 5A:
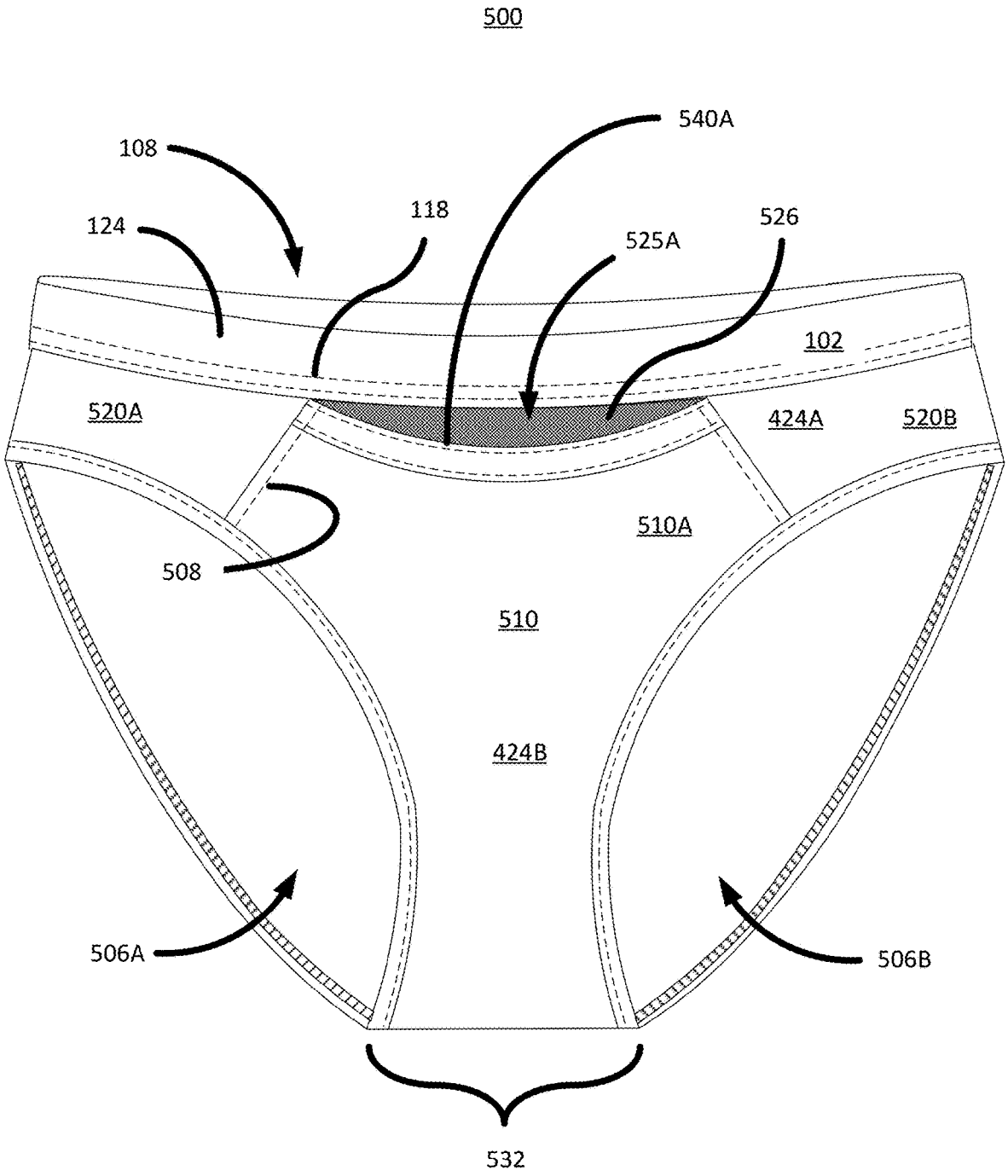
FIGS. 5A-5D are line drawings of a bikini style odor control underwear embodiment useable with an adsorbent sleeve consistent with embodiments of the present invention.
Figure 5B:
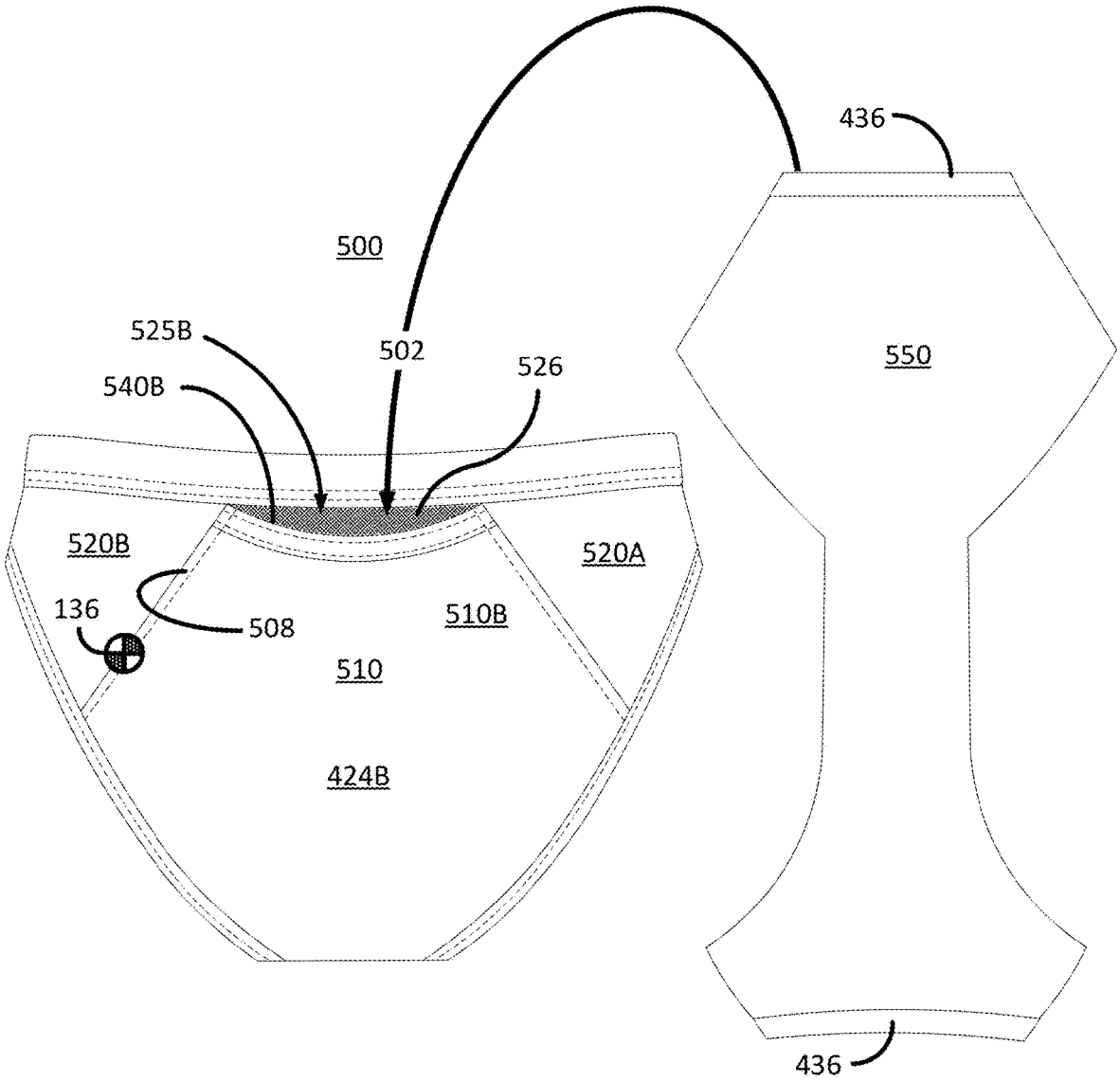

FIGS. 5A-5D are line drawings of a bikini style odor control underwear embodiment and adsorbent sleeve consistent with embodiments of the present invention. The women's bikini style odor control underwear embodiment 500 (or simply bikini underwear) comprises the same general elements of the underwear 400 of FIGS. 4A and 4B but in a bikini style. Specifically, FIG. 5A illustratively depicts a front side of a bikini underwear embodiment 500 with an adsorbent sleeve accommodating pocket 526 (or simply pocket) with a front access port 525A that is shown open to receive an adsorbent sleeve 550, as depicted in FIG. 5B. The bikini underwear 500 extends between a waist opening 108 and two leg openings 506A and 506B. In this embodiment, the bikini underwear 500 includes the side panels 520A and 520B, the center panel 510 and all connective stitching, such as the interface 508 (i.e., seams) at the front side panel 510A that fixedly connect the side panels 520 to the front side panel 510B. An inseparable unitary elastic waistband 102 defines the waist opening 108. The inseparable unitary elastic waistband 102 is sewn to the side panels 520 and an inner ply 542B of the center panel 510 at waistband seam 118. Certain embodiments contemplate the side panels 520A and 520B being a single-ply fabric 424A as with the underwear embodiment 400.

As shown, the underwear crotch region 532 is also defines the center panel crotch between each of the leg openings 406. The center panel 510 is a two-ply fabric 424B that defining a pocket 526 between the two-ply fabric 424B. The pocket 526 extends uninterrupted through the center panel crotch 532 thereby defining a continuous pocket from essentially the front pocket lip 540A to the rear pocket lip 540B. The front access port 525A is opened revealing the inside of the pocket 526.

FIG. 5B illustratively depicts a rear view of the bikini underwear 500 showing a rear access port 525B of the pocket 526 open to receive an adsorbent sleeve 550. The major difference between the front and rear view of the bikini underwear 500 is that the rear center panel 510B is wider in the back to cover a wearers back-side. More specifically, the rear center panel 510B is wider with stitching 508 that tracks over, or otherwise traverses, a person's buttocks apex, shown here as target 136. The rear pocket 526 depicts the rear access port 525B opened. The adsorbent sleeve 550 is shaped to conform to the bikini underwear's pocket 526, in a manner like that shown in FIGS. 4F-4H. Also, like in the embodiments of the underwear 400, the adsorbent sleeve 550 comprises adsorbent sleeve NCC strips 436 that are configured to align with bikini underwear NCC strips 435 at the front and rear pocket lips 540A and 540B (as depicted in conjunction with FIG. 4E). As shown by the arrow 502, the adsorbent sleeve 550 is configured and adapted to be inserted manually in the bikini underwear's pocket 526, weaved through the center panel crotch 532, pulled from the front access port 525A by manually gripping the adsorbent sleeve 550 until the adsorbent sleeve NCC strips 436 are aligned with the bikini underwear NCC strips 435 whereby the front and rear access ports 525A and 525B are pressed against the adsorbent sleeve 550 to seal the front and rear access ports 525A and 525B closed.

Figure 5C:
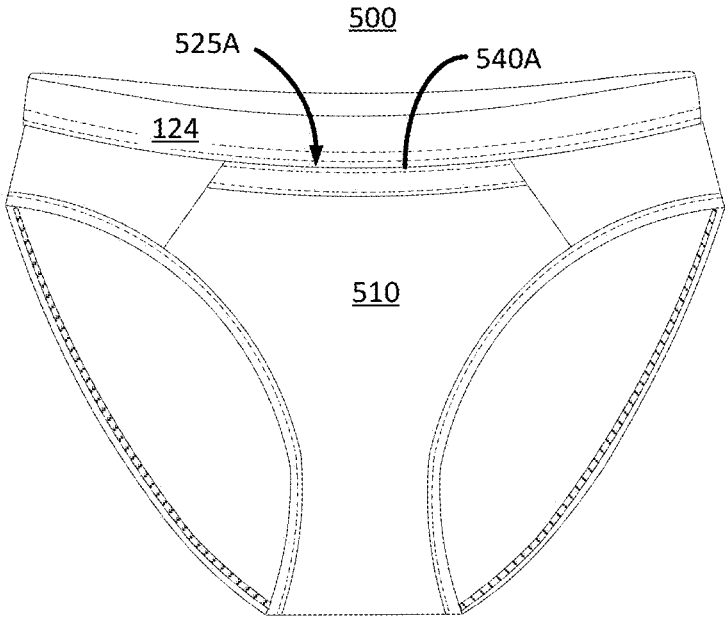
Figure 5D:
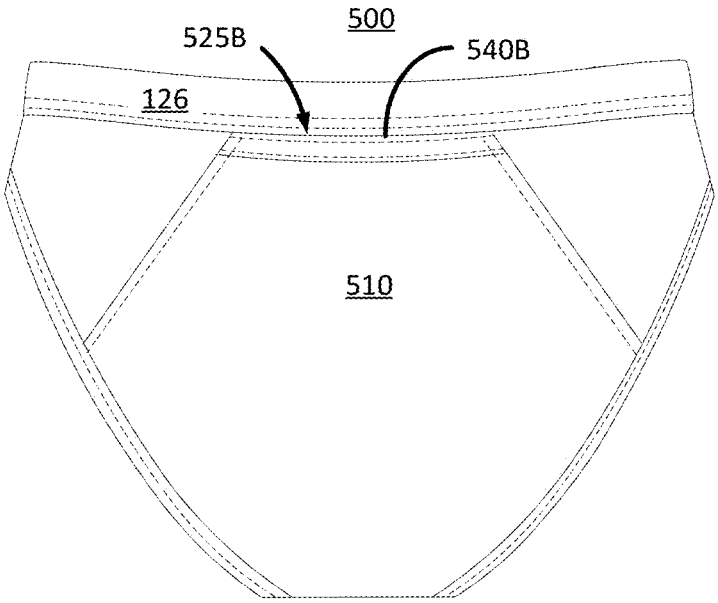

FIGS. 5C and 5D illustratively depict the front and back views of the bikini underwear 500 with the front access port 525A and the rear access port 525B closed, respectively. As shown in FIG. 5C the front pocket lip 540A is closed right under, or essentially at, the waistband front 124 thereby sealing the front access port 525A. Likewise, as shown in FIG. 5D the rear pocket lip 540B is closed right under, or essentially at, the waistband rear 126 thereby sealing the rear access port 525B. This, as should be appreciated, is accomplished with the adsorbent sleeve 550 inserted and the NCC strips 535 and 536 engaged.

With the present description in mind, below are some examples of certain embodiments illustratively complementing some of the methods and apparatus embodiments to aid the reader. The elements called out below in view of the various figures are examples provided to assist in understanding the present invention and accordingly should not be considered limiting.

In that light, one embodiment of the present invention, described in view of figures, envisions an underwear embodiment 400 with a removable odor mitigating sleeve 450, as shown in FIGS. 4A-4K. The underwear 400 can comprise a center panel 410 separating a first and a second side panel 420A and 420B, wherein the center panel 410 traverses a crotch region 430, as shown in FIGS. 4A and 4B. The center panel 410 extends towards a waistband 102 at a waistband front 124 and a waistband rear 126. The first side panel 420A extends from the waistband 102 to a first leg aperture 406A and the second side panel 420B extends from the waistband 102 to a second leg aperture 406B. The crotch region 430 separates each of the leg apertures 406A and 406B. The side panels 420A and 420B comprise a single layer 424A of fabric 424 and the center panel 410 comprises two layers 424B of the fabric 424, wherein the center panel 410 comprising a pocket 426 between the two layers, as shown in FIG. 4E. The center panel 410 further comprises a front access port 425A at the waistband front 124 and a rear access port 425B at the waistband rear 126. The underwear 400 further comprises an adsorbent sleeve 450 that is configured to be disposed in the pocket 426. The adsorbent sleeve 450 is configured to be constrained at the front access port 425A and the rear access port 425B, as shown in FIGS. 4F-4L. The adsorbent sleeve 450 unconstrained within the pocket 426. The adsorbent sleeve 450 comprises an activated carbon sheet 460 joined between a bamboo fabric 434, as shown in FIG. 4L.

The underwear embodiment 400 further envisions the thickness of the adsorbent sleeve 450 being greater than 2 mm.

The underwear embodiment 400 further contemplates the fabric 424 comprising at least 90% bamboo and at least 3% spandex.

The underwear embodiment 400 further imagines the adsorbent sleeve 450 defining a front surface 422A and a back surface 422B, wherein each of which comprises an outer facing NCC strip 436 at a first end 452 and at a second end 454 of the adsorbent sleeve 450. The shaped adsorbent sleeve 450 can be hourglass shaped having a back segment 456 that flares to the first end 452 from a crotch segment 455 and a front segment 457 that flares to the second end 454 from the crotch segment 455, the crotch segment 455 being configured to span a center panel crotch 432 in the crotch region 430, as shown in FIGS. 4F-4H. The underwear 400 can further comprise underwear NCC strips 435 that are configured to engage the outer facing NCC strips 436 that are located on an inner surface 442A and 442B of each of the center panel 410 layers 424B at a respective lip 440A and 440B of the front access port 425A and the rear access port 425B. The front access port 425A and the rear access port 425B can be closed and sealed against the underwear NCC strips 435 and the outer facing NCC strips 436 when engaged, as shown in FIGS. 4C and 4D.

The underwear embodiment 400 further envisioning the activated carbon sheet 460 being connected to the bamboo fabric 434 via sleeve stitching 462, as shown in FIG. 4F.

The underwear embodiment 400 further contemplating the activated carbon sheet 460 being a carbon felt 464 sandwiched between cotton mesh 465, as shown in FIGS. 4L.

The underwear embodiment 400 further imagining the activated carbon sheet 460 being permeable to gas and vapor.

The underwear embodiment 400 can further comprise a means for constraining the adsorbent sleeve 450 to the underwear 400 at the front access port 425A and the rear access port 425B. The means for constraining can be snaps, hooks, buttons, zippers, etc. known to those skilled in the art.

Yet another embodiment of the present invention further contemplates a filter underwear 400 with a removable odor mitigating sleeve 450, as shown in FIGS. 4A-4K. The underwear 400 can comprise a center panel 410 that separates a pair of side panels 420A and 420B, as shown in FIGS. 4A and 4B. The center panel 410 traversing a crotch region 430. The center panel 410 can also comprise a front access port 425A at a waistband front 124 and a rear access port 425B at a waistband rear 126. The crotch region 430 separates a pair of leg apertures 406A and 406B. The side panels 420A and 420B can comprise a single layer 424A of fabric 424, wherein the center panel 410 can comprise two layers 424B of the fabric 424. The center panel 410 comprises a pocket 426 defined between the two layers 424B, as shown in FIG. 4E. The filter underwear 400 can further comprise an adsorbent sleeve 450 removably disposed in the pocket 426 and constrained at the front access port 425A and the rear access port 425B, as shown in FIGS. 4F-4L. Except for at the front access port 425A and the rear access port 425B, the adsorbent sleeve 450 is unconstrained within the pocket 426. The adsorbent sleeve 450 comprises an activated carbon sheet 460 joined between a bamboo fabric 434, as shown in FIG. 4L.

The filter underwear 400 further envisions the center panel 410 widening from the crotch region 430 to the waistband rear 126, a center panel to side panel interface 408 being configured to reside essentially over a buttocks apex of a person when worn by the person, as shown in FIG. 4B.

The filter underwear 400 further imagines the shaped adsorbent sleeve 450 being hourglass shaped having a back segment 456 that flares to a first end 452 from a crotch segment 455 and a front segment 457 that flares to a second end 454 from the crotch segment 455, the crotch segment 455 is configured to span a center panel crotch 432 in the crotch region 430, as shown in FIG. 4J.

The filter underwear 400 further contemplates the adsorbent sleeve 450 defining a front surface 422A and a back surface 422B, each of which comprise an outer facing NCC strip 436 at a first end 452 and at a second end 454 of the adsorbent sleeve 450 that are matingly engaged with underwear NCC strips 435 on an inner surface 442A and 442B of each of the center panel 410 layers 424B at a respective lip 440A and 440B of the front access port 425A and the rear access port 425B, as shown in FIGS. 4E, 4J and 4K.

The filter underwear 400 further envisions the activated carbon sleeve 450 comprising a carbon felt 464, as shown in FIG. 4L.

Still another embodiment of the present invention contemplates a method to combine an adsorbent sleeve 450 in a filter underwear 400. The method comprising a step for inserting the adsorbent sleeve 450 in either a front access port 425A or a rear access port 425B of a panel pocket 426 of a center panel 410 having two fabric layers 424B, wherein the front access port 425A and the rear access port 425B are located approximately at a waistband 102 of the filter underwear 400, as shown in FIG. 4F. The adsorbent sleeve 450 comprises an activated carbon sheet 460 that is joined between a first and a second layer of bamboo fabric 434, as shown in FIG. 4J. The method further comprising a step for sealing the rear access port 425B by connecting a first end 452 of the adsorbent sleeve 450 at a rear lip 440B of the panel pocket 426 and sealing the front access port 425A by connecting a second end 454 of the adsorbent sleeve 450 at a front lip 440A of the panel pocket 426. The adsorbent sleeve 450 unconstrained in the panel pocket 426 except for at the first end 452 and the second end 454.

The method further envisions the filter underwear 400 comprising a pair of side panels 420A and 420B separated by the center panel 410, the side panels 420A and 420B comprising a single fabric layer 424A.

The method further imaging the connecting step being accomplished by compressing outward facing NCC strips 436A and 436B located at the first end 452 with inward facing NCC strips 436A and 436B located at the respective lips 440A and 440B.

The method further contemplating the activated carbon sheet 460 comprising a carbon felt 464.

Yet another embodiment envisions an underwear embodiment 100 that generally comprises an underwear body 105 that extends between a waist aperture 108 and two leg apertures 106*a* and 106*b*. The underwear body 105 is geometrically defined by two underwear sides 104*a* and 104*b*, an underwear front 140 and an underwear back 150. Each of the leg apertures 106*a*/106*b* extend from one of the underwear sides 104*a*/104*b* to a crotch region 130 of the underwear body 105. An inseparable unitary elastic waistband 102 defining the waist aperture 108. The underwear body 105 comprises two side panels 120*a* and 120*b*, a center panel 110, as well as connective stitching 112 that holds the side panels 120 and the center panel 110 together. The connective stitching 112 also confines the center panel 110 and all of its laminated plies, irremovably to the underwear body 105. Each of the side panels 120*a*/120*b* extend from the waistband 102 to a corresponding one of the leg apertures 106*a*/106*b*. Each of the side panels 120*a*/120*b* completely encompass a corresponding one of the underwear sides 104*a*/104*b*. The center panel 110 extends from the waistband 102 at the underwear back 150 to the waistband 102 at the underwear front 140. The center panel 110 is interposed between the side panels 120*a*/120*b*. The center panel 110 passes through the crotch region 130 contiguously. The side panels 120*a*/120*b* consist of fabric that is a single layer of bamboo fabric. The center panel 110 consists of activated carbon fabric 302 bonded, via a bonding agent, to and sandwiched between a first layer of cotton fabric 304 and a second layer of cotton fabric 306, the cotton fabric 304/306 is irremovably sandwiched between a first outer layer of the bamboo fabric 310 and an second outer layer of the bamboo fabric 312. By irremovably sandwiched it is meant that the activated carbon fabric 302 and cotton fabric 304/306 (the laminate 308) cannot be removed from the underwear 100 without destroying the underwear 100 because the laminate 308 is sewn into, or otherwise irremovably attached to, the laminate 308.

Certain aspects of the underwear embodiment 100 are additionally envisioned to include a thickness of the center panel 110, which is greater than 1 mm. Certain embodiments contemplate the carbon fabric 302 being approximately 0.8 mm thick, the cotton fabric 304/306 being approximately 0.4 mm, the bamboo fabric 310/312 being approximately 0.25 mm thick, wherein the bonded three-ply cotton/carbon laminate 308 can have a thickness of approximately 1.5 mm with a total center panel 110 thickness being approximately 2 mm thick.

The underwear embodiment 100 is further envisioned having the activated carbon fabric 302, the first layer of cotton fabric 304 and the second layer of cotton fabric 306, and the bamboo fabric 310/312 are irremovably connected to the underwear.

The underwear embodiment 100 further contemplates the side panels 120*a*/120*b* and the center panel 110 are gas permeable and vapor permeable.

The underwear embodiment 100 further envisions the waist band 102 further comprising the activated carbon fabric 302.

The underwear embodiment 100 can further comprise at least one elastic member 160 attached at an interface between the center panel 110 and at least one of the side panels 120*a*/120*b*.

The underwear embodiment 100 further envisions the activated carbon fabric 302, the cotton fabric 304/306 and the bamboo fabric 310/312 are devoid of polyamides.

The underwear embodiment 100 can further include having the center panel 110 only extends over part of the wearer's buttocks when warn.

The underwear embodiment 100 can further be wherein the side panels 120*a* and 120*b* are not contiguous to one another.

The underwear embodiment 100 can further be wherein the center panel 110 widens from the crotch region 130 to the waistband 102 at the underwear back 150 and wherein an interface 113 between the center panel 110 and one of the side panels 120*a*/120*b* is configured to reside essentially over a buttocks apex 136 of a person when warn by the person.

The underwear embodiment 100 can further be wherein the center panel 110 widens from the crotch region 130 to the waistband 102 at the underwear back 150 and wherein an interface 113 between the center panel 110 in one of the side panels 120*a*/120*b* is configured to reside between a buttocks apex 136 of a person and a coronal plane (the side) of the person when warn by the person.

The underwear embodiment 100 can further be wherein the center panel 110 passes through the crotch region 130 and completely encompasses the crotch region 130.

The underwear embodiment 100 can further be wherein the two side panels 120*a* and 120*b* are a single ply of bamboo fabric.

The underwear embodiment 100 can further be wherein the two side panels 120*a* and 120*b* are a single ply of bamboo fabric except for a cuff 116 defined between a leg seam 114 and a corresponding one of the two leg apertures 106*a* and 106*b*.

The underwear embodiment 100 can further be wherein the underwear are devoid of any gusset in the crotch region 130.

The underwear embodiment 100 can further comprise a crotch dart 122 in the center panel 110 in the underwear front 140 extending from the crotch region 130 towards the waist band 102.

The underwear embodiment 100 can further be wherein the center panel 110 consists of a front panel 111*a* and a back panel 111*b* sewn together via a transfer seam 113 in the crotch region 130.

The underwear embodiment 100 can further comprise two leg cuffs 216 that encompassed each of the two leg apertures 206*a* and 206*b*, the center panel 210 extending along more than 50% of the leg cuffs 216 along and adjacent to a center panel-to-cuff interface 254 towards the two underwear sides 204*a* and 204*b*, the center panel-to-cuff interface 254 defines where the center panel 210 interfaces the two leg apertures 206*a* and 206*b*.

The underwear embodiment 100 can further be wherein the center panel 210 transitions from the leg cuff seam 252 towards the waistband 202 at essentially a sharp angle 246.

Yet another embodiment of the present invention further contemplates a filter undergarment 200 comprising an undergarment body 105 defined by two undergarment sides 204*a* and 204*b*, an undergarment front 240 and an undergarment back 250. The undergarment body 205 extends between an inseparable unitary elastic waistband 202 (waistband) and two leg apertures 206*a* and 206*b*. The filter undergarment further has a waist aperture 208 that is defined by a waistband edge 215 of the waistband 202. A center panel 210 extends from the waistband 202 at the under garment back 250, traversing between the two leg apertures 206*a* and 206*b* to the undergarment front 240. The center panel 210 is a five-ply filter fabric 300 that is essentially composed of an activated carbon fabric 302 that is bonded between two cotton fabric panels 304 and 306 that are sandwiched and attached between two bamboo fabric panels 310/312. By 'essentially composed' it is meant that there may be thread, glue or other minor elements that hold together the center panel 210 or provide attachment to the side panels 220 but the majority of the panels are the activated carbon fabric 302, cotton panels 304/306 and the bamboo panels 310/312. One-ply bamboo fabric encompasses the two undergarment sides 204*a* and 204*b*. There are two leg cuffs 216 each of which define one of the two leg apertures 106*a* and 106*b*, the leg cuffs 216 comprising a one-ply bamboo fabric folded over itself. A center panel-to-cuff interface 254 defines where the center panel 210 interfaces each of the leg cuffs 216. The center panel 210 extends between 35%-75% of the leg cuffs 216 along and adjacent to the center panel-to-cuff interface 254 and towards the two underwear sides 204*a* and 204*b* in the undergarment front 240 and the undergarment back 250.

The filter undergarment embodiment 100 further envisioning wherein the center panel 210 extends from the center panel-to-cuff interface 254 to a waistband interface 218 at the waistband 202. This can further be wherein the center panel 210 extends from the center panel-to-cuff interface 254 towards the waistband 202 at a sharp angle 246 where the center panel 210 transitions from the center panel-to-cuff interface 254.

The filter undergarment embodiment 100 further contemplating wherein the center panel 210 terminates from the center panel-to-cuff interface 254 into the one-ply bamboo fabric at a front-to-center panel interface 225, the front-to-center panel interface 225 extends from one of the leg cuffs 216 to the other of the leg cuffs 216.

Still another embodiment of the present invention contemplates a filter underwear 100 generally comprising an undergarment body 105 defined by two undergarment sides 104*a* and 104*b*, an undergarment front 140 and an undergarment back 150, wherein the undergarment body 105 extends between an inseparable unitary elastic waistband 102 (waistband) and two leg apertures 106*a* and 106*b*. A waist aperture 108 is defined by a waistband edge 115 of the waistband 102. The filter underwear 100 further includes a center panel 110 attached to and extending from the waistband 102 at the under garment back 150 and traversing between the two leg apertures 106*a* and 106*b* to the waistband 102 at the undergarment front 140. The center panel 110 is configured to only extend over part of a wearer's buttocks when worn by a wearer. The center panel 110 is a filter fabric 300 comprising five plies, wherein each ply is from a set consisting of an activated carbon fabric 302, a cotton fabric 304/306, and bamboo fabric 310/312. The activated carbon fabric 302 is bonded between two sheets of cotton fabric 304 and 306 that are sandwiched between and irremovably attached to bamboo fabric 310 and 312. The center panel 110 is greater than 1 mm thick. The filter underwear 100 has one-ply bamboo fabric side panels 120*a* and 120*b* that each comprise one of the undergarment sides 104*a* and 104*b*. The undergarment is permeable to gas and vapor. The waist band 102 can further comprise the activated carbon fabric 302 in yet another embodiment.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, the term 'attached' can mean to be sewn, glued, stapled or some other affixing means known to those skilled in the art without departing from the scope and spirit of the present invention. Furthermore, it should be appreciated that certain geometrical elements and description of similar elements in FIGS. 4A-4L are able to be exchanged with those described in conjunction with FIGS. 5A-5D and vice versa without departing from the scope and spirit of the present invention. It should further be understood that the concept of the pocket and odor adsorbing carbon sleeve, whether an activated carbon or otherwise, can equally be employed in other garments such as the armpit region of a shirt, for example, without departing from the spirit of the present invention. Also, though different undergarment embodiments can be inventive as a whole, individual undergarment components or elements can be equally inventive and stand alone. Further, the terms "one" is synonymous with "a", which may be a first of a plurality.

It will be clear that the present invention is well adapted to attain the ends and advantages mentioned as well as those inherent therein. While presently preferred embodiments have been described for purposes of this disclosure, numerous changes may be made which readily suggest themselves to those skilled in the art and which are encompassed in the spirit of the invention disclosed.

What is claimed is:

1. An underwear comprising:

a center panel separating a first and a second side panel, the center panel traversing a crotch region, the center panel extending towards a waistband at a waistband front and a waistband rear, the first side panel extending from the waistband to a first leg aperture and the second side panel extending from the waistband to a second leg aperture, the crotch region separating each of the leg apertures, the side panels comprising a single layer of fabric, the center panel comprising two layers of the fabric, the center panel comprising a pocket between the two layers, the center panel comprising a front access port at the waistband front and a rear access port at the waistband rear; and an adsorbent sleeve configured to be disposed in the pocket, the adsorbent sleeve configured to be constrained at the front access port and the rear access port, the adsorbent sleeve unconstrained within the pocket, the adsorbent sleeve comprising an activated carbon sheet joined between a bamboo fabric.

2. The underwear of claim 1, wherein a thickness of the adsorbent sleeve is greater than 2 mm.

3. The underwear of claim 1, wherein the fabric comprises at least 90% bamboo and at least 3% spandex.

4. The underwear of claim 1, wherein the adsorbent sleeve defines a front surface and a back surface, each of which comprises an outer facing nonpermanent closing connector (NCC) strip at a first end and at a second end of the adsorbent sleeve.

5. The underwear of claim 4, wherein the shaped adsorbent sleeve is hourglass shaped having a back segment that flares to the first end from a crotch segment and a front segment that flares to the second end from the crotch segment, the crotch segment configured to span a center panel crotch in the crotch region.

6. The underwear of claim 5, wherein the underwear comprise underwear NCC strips configured to engage the outer facing NCC strips, the underwear NCC strips located on an inner surface of each of the center panel layers at a respective lip of the front access port and the rear access port.

7. The underwear of claim 6, wherein the front access port and the rear access port are closed and sealed against the underwear NCC strips and the outer facing NCC strips when engaged.

8. The underwear of claim 1, wherein the activated carbon sheet is connected to the bamboo fabric via sleeve stitching.

9. The underwear of claim 1, wherein the activated carbon sheet is a carbon felt sandwiched between cotton mesh.

10. The underwear of claim 1, wherein the activated carbon sheet is permeable to gas and vapor.

11. The underwear of claim 1 further comprising a means for constraining the adsorbent sleeve to the underwear at the front access port and the rear access port.

12. A filter underwear comprising:

a center panel separating a pair of side panels, the center panel traversing a crotch region, the center panel comprising a front access port at a waistband front and a rear access port at a waistband rear, the crotch region separating a pair of leg apertures, the side panels comprising a single layer of fabric, the center panel comprising two layers of the fabric, the center panel comprising a pocket defined between the two layers; and an adsorbent sleeve removably disposed in the pocket and constrained at the front access port and the rear access port, except for at the front access port and the rear access port, the adsorbent sleeve is unconstrained within the pocket, the adsorbent sleeve comprising an activated carbon sheet joined between a bamboo fabric.

13. The filter underwear of claim 12, wherein the center panel widens from the crotch region to the waistband rear, a center panel to side panel interface 408 is configured to reside essentially over a buttocks apex of a person when worn by the person.

14. The filter underwear of claim 12, wherein the shaped adsorbent sleeve is hourglass shaped having a back segment that flares to a first end from a crotch segment and a front segment that flares to a second end from the crotch segment, the crotch segment configured to span a center panel crotch in the crotch region.

15. The filter underwear of claim 12, wherein the adsorbent sleeve defines a front surface and a back surface, each of which comprise an outer facing nonpermanent closing connector (NCC) strip at a first end and at a second end of the adsorbent sleeve that are matingly engaged with underwear NCC strips on an inner surface of each of the center panel layers at a respective lip of the front access port and the rear access port.

16. The filter underwear of claim 12, wherein the activated carbon sleeve comprises a carbon felt.

* * * * *